US010242624B2

(12) United States Patent
Chen et al.

(10) Patent No.: US 10,242,624 B2
(45) Date of Patent: Mar. 26, 2019

(54) DISPLAY DEVICE

(71) Applicant: InnoLux Corporation, Miao-Li County (TW)

(72) Inventors: Lien-Hsiang Chen, Miao-Li County (TW); Kung-Chen Kuo, Miao-Li County (TW); Ming-Chun Tseng, Miao-Li County (TW)

(73) Assignee: INNOLUX CORPORATION, Miao-Li County (TW)

( * ) Notice: Subject to any disclaimer, the term of this patent is extended or adjusted under 35 U.S.C. 154(b) by 8 days.

(21) Appl. No.: 15/224,736

(22) Filed: Aug. 1, 2016

(65) Prior Publication Data

US 2017/0047010 A1 Feb. 16, 2017

(30) Foreign Application Priority Data

Aug. 13, 2015 (CN) ..... 2015 1 0495669

(51) Int. Cl.
*G09G 3/3258* (2016.01)
*G09G 3/3291* (2016.01)

(52) U.S. Cl.
CPC ..... *G09G 3/3258* (2013.01); *G09G 3/3291* (2013.01); *G09G 2300/043* (2013.01); *G09G 2310/0202* (2013.01); *G09G 2310/08* (2013.01); *G09G 2320/0233* (2013.01)

(58) Field of Classification Search
CPC ..... G09G 3/3258; G09G 3/3291
See application file for complete search history.

(56) References Cited

U.S. PATENT DOCUMENTS

2005/0162354 A1* 7/2005 Osame ..... G09G 3/3233 345/76
2005/0212787 A1* 9/2005 Noguchi ..... G09G 3/3233 345/204
2006/0125807 A1* 6/2006 Park ..... G09G 3/3233 345/204
2007/0024542 A1* 2/2007 Chung ..... G09G 3/2011 345/76
2012/0120042 A1* 5/2012 Tsai ..... G09G 3/3233 345/211
2013/0002632 A1* 1/2013 Choi ..... G09G 3/325 345/211
2015/0348464 A1* 12/2015 In ..... G09G 3/2022 345/205
2016/0125808 A1* 5/2016 Hsu ..... G09G 3/3233 345/212

FOREIGN PATENT DOCUMENTS

CN 104464635 A 3/2015

OTHER PUBLICATIONS

Chinese language Office Action dated Jan. 3, 2019, issued in application No. CN 201510495669.7.

* cited by examiner

*Primary Examiner* — Nitin Patel
*Assistant Examiner* — Robert M Stone
(74) *Attorney, Agent, or Firm* — McClure, Qualey & Rodack, LLP

(57) ABSTRACT

A driving device includes a pixel array, a controller and a driver. The driver has a plurality of driving devices. Each of the driving devices includes a plurality of transistors and at least one capacitor to drive a light emitting device. By controlling the timing scheme of control signals applied to the driving device, the voltage for driving the light emitting device would not be affected by threshold voltages of the transistors.

10 Claims, 13 Drawing Sheets

DISPLAY DEVICE

CROSS REFERENCE TO RELATED APPLICATIONS

This application claims priority of China Patent Application No. 201510495669.7, filed on Aug. 13, 2015, the entirety of which is incorporated by reference herein.

BACKGROUND OF THE INVENTION

Field of the Invention

The disclosure relates to a display device, and more particularly to a driving device of a display device.

Description of the Related Art

Generally, a flat panel display has a plurality of display pixels. Each pixel has a drive transistor and a light-emitting element. The driving transistor generates a driving current according to an image signal. The light-emitting element emits the corresponding luminance according to the driving current.

Due to the influence of manufacturing process, different pixel driving transistors may have different threshold voltages. When different driving transistors receive the same image signal, they may produce different drive currents, and the light-emitting elements exhibit a different brightness accordingly.

In order to avoid the brightness of the light-emitting element being affected by the threshold voltage of the corresponding driving transistor, the conventional practice uses a compensation unit to compensate for effects caused by the threshold voltage of the driving transistor. However, with the development of technology, the size of the flat panel display is increased. If each pixel is integrated with a compensation unit, it will reduce the aperture ratio of the display.

BRIEF SUMMARY OF THE INVENTION

An embodiment of the disclosure provides a driving device comprising five PMOS transistors and one capacitor. The driving device comprises a first transistor having a first terminal coupled to a first node, a second terminal coupled to a second node, and a gate terminal coupled to a third node; a second transistor having a first terminal coupled to the first node, a second terminal coupled to the third node, and a gate terminal to receive a first control signal; a third transistor having a first terminal coupled to the second node, a second terminal to receive a display signal, and a gate terminal to receive a second control signal; a fourth transistor having a first terminal coupled to a light-emitting device, a second terminal coupled to the first node, and a gate terminal to receive a third control signal; a fifth transistor having a first terminal coupled to a high voltage level (or a high voltage signal), a second terminal coupled to the second node, and a gate terminal to receive a fourth control signal; a capacitor having a first terminal coupled to the high voltage level and a second terminal coupled to the third node; and the light-emitting device having a first terminal coupled to a low voltage level (or a low voltage signal) and a second terminal coupled to the first terminal of the fourth transistor.

In one embodiment of the disclosure, the operation of the driving device is described in the following paragraph. At a first time point, the second control signal and the fourth control signal are at a high voltage logic level to turn off the third transistor and the fifth transistor, and the first control signal and the third control signal are at a low voltage logic level to turn on the second transistor and the fourth transistor. At a second time point, the second control signal is changed to the low voltage logic level to turn on the third transistor, and the third control signal is changed to the high voltage logic level to turn off the fourth transistor. At a third time point, the first control signal and the second control signal are changed to the high voltage logic level to turn off the second transistor and the third transistor, and the third control signal and the fourth control signal are changed to the low voltage logic level to turn on the fourth transistor and the fifth transistor.

In one embodiment of the disclosure, the first control signal is the same as the second control signal, and the operation of the driving device is described in the following paragraph. At a first time point, the first control signal, the second control signal, and the third control signal are at a low voltage logic level to turn on the second transistor, the third transistor and the fourth transistor, and the fourth control signal is at a high voltage logic level to turn off the fifth transistor. At a second time point, the third control signal is changed to the high voltage logic level to turn off the fourth transistor. At a third time point, the first control signal and the second control signal are changed to the high voltage logic level to turn off the second transistor and the third transistor, and the third control signal and the fourth control signal are changed to the low voltage logic level to turn on the fourth transistor and the fifth transistor.

In one embodiment of the disclosure, the third control signal is the same as the fourth control signal, and the operation of the driving device is described in the following paragraph. At a first time point, the second control signal is at a high voltage logic level to turn off the third transistor, and the first control signal, the third control signal and the fourth control signal are at a low voltage logic level to turn on the second transistor, the fourth transistor and the fifth transistor. At a second time point, the third control signal and the fourth control signal are changed to the high voltage logic level to turn off the fourth transistor and the fifth transistor. At a third time point, the second control signal is changed to the low voltage logic level to turn on the third transistor. At a fourth time point, the second control signal is changed to the high voltage logic level to turn off the third transistor, and the third control signal and the fourth control signal are changed to the low voltage logic level to turn on the fourth transistor and the fifth transistor.

In one embodiment of the disclosure, the first control signal is the same as the second control signal, the third control signal is the same as the fourth control signal, and the operation of the driving device is described in the following paragraph. At a first time point, the first control signal, the second control signal, the third control signal and the fourth control signal are at a low voltage logic level to turn on all transistors of the driving device. At a second time point, the third control signal and the fourth control signal are changed to a high voltage logic level to turn off the fourth transistor and the fifth transistor. At a third time point, the first control signal and the second control signal are changed to the high voltage logic level to turn off the second transistor and the third transistor. At a fourth time point, the first control signal and the second control signal are changed to the low voltage logic level to turn on the second transistor and the third transistor. At a fifth time point, the first control signal and the second control signal are changed to the high voltage logic level to turn off the second transistor and the third transistor, and the third control signal and the fourth control signal are changed to the low voltage logic level to turn on the fourth transistor and the fifth transistor.

An embodiment of the disclosure provides a driving device comprising six PMOS transistors and one capacitor. The driving device comprises a first transistor having a first terminal coupled to a first node, a second terminal coupled to a second terminal, and a gate terminal coupled to a third node; a second transistor having a first terminal coupled to the first node, a second terminal coupled to the third node and a gate terminal to receive a first control signal; a third transistor having a first terminal coupled to the second node, a second terminal to receive a display signal, and a gate terminal to receive a second control signal; a fourth transistor having a first terminal coupled to a fourth node, a second terminal coupled to the first node, and a gate terminal to receive a third control signal; a fifth transistor having a first terminal coupled to a high voltage level, a second terminal couple to the second node, and a gate terminal to receive a fourth control signal; a sixth transistor having a first terminal coupled to a reference voltage level, a second terminal coupled to the fourth node, and a gate terminal to receive a reset signal; a capacitor having a first terminal coupled to the high voltage level, and a second terminal coupled to the third node; and a light-emitting device having a first terminal coupled to a low voltage level and a second terminal coupled to the fourth node.

In one embodiment of the disclosure, the operation of the driving device is described in the following paragraph. At a first time point, the second control signal and the fourth control signal are at a high voltage logic level to turn off the third transistor and the fifth transistor, and the reset signal, the first control signal and the third control signal are at a low voltage logic level to turn on the sixth transistor, the second transistor and the fourth transistor. At a second time point, the second control signal is changed to the low voltage logic level to turn on the third transistor, and the third control signal and the reset signal are changed to the high voltage logic level to turn off the fourth transistor and the sixth transistor. At a third time point, the first control signal and the second control signal are changed to the high voltage logic level to turn off the second transistor and the third transistor, and the third control signal and the fourth control signal are changed to the low voltage logic level to turn on the fourth transistor and the fifth transistor.

In one embodiment of the disclosure, the first control signal is the same as the second control signal, and the operation of the driving device is described in the following paragraph. At a first time point, the fourth control signal is at a high voltage logic level to turn off the fifth transistor, the reset signal, the first control signal, the second control signal, and the third control signal are at a low voltage logic level to turn on the sixth transistor, the second transistor, the third transistor and the fourth transistor. At a second time point, the third control signal is changed to the high voltage logic level to turn off the fourth transistor. At a third time point, the reset signal, the first control signal and the second control signal are changed to the high voltage logic level to turn off the sixth transistor, the second transistor and the third transistor, and the third control signal and the fourth control signal are changed to the low voltage logic level to turn on the fourth transistor and the fifth transistor.

In one embodiment of the disclosure, the third control signal is the same as the fourth control signal, and the operation of the driving device is described in the following paragraph. At a first time point, the second control signal is at a high voltage logic level to turn off the third transistor, and the reset signal, the first control signal, the third control signal and the fourth control signal are at a low voltage logic level to turn on the sixth transistor, the second transistor, the fourth transistor and the fifth transistor. At a second time point, the third control signal and the fourth control signal are changed to the high voltage logic level to turn off the fourth transistor and the fifth transistor. At a third time point, the second control signal is changed to the low voltage logic level to turn on the third transistor. At a fourth time point, the reset signal is changed to the high voltage logic level to turn off the sixth transistor. At a fifth time point, the first control signal and the second control signal are changed to the high voltage logic level to turn off the second transistor and the third transistor, and the third control signal and the fourth control signal are changed to the low voltage logic level to turn on the second transistor, the fourth transistor and the fifth transistor.

In one embodiment of the disclosure, the first control signal and the second control signal are the same, the third control signal is the same as the fourth control signal, and the operation of the driving device is described in the following paragraph. At a first time point, the reset signal, the first control signal, the second control signal, the third control signal and the fourth control signal are at a low voltage logic level to turn on all transistors of the driving device. At a second time point, the third control signal and the fourth control signal are changed to a high voltage logic level to turn off the fourth transistor and the fifth transistor. At a third time point, the first control signal and the second control signal are changed to the high voltage logic level to turn off the second transistor and the third transistor. At a fourth time point, the first control signal and the second control signal are changed to the low voltage logic level to turn on the second transistor and the third transistor. At a fifth time point, the first control signal and the second control signal are changed to the high voltage logic level to turn off the second transistor and the third transistor, and the third control signal and the fourth control signal are changed to the low voltage logic level to turn on the fourth transistor and the fifth transistor.

Another embodiment of the disclosure provides a driving device comprising five NMOS transistors and one capacitor. The driving device comprises a first transistor having a first terminal coupled to a first node, a second terminal coupled to a second node, and a gate terminal coupled to a third node; a second transistor having a first terminal coupled to the first node, a second terminal coupled to the third node, and a gate terminal to receive a first control signal; a third transistor having a first terminal coupled to the second node, a second terminal to receive a display signal, and a gate terminal to receive a second control signal; a fourth transistor having a first terminal coupled to a fourth node, a second terminal coupled to the second node, and a gate terminal to receive a fourth control signal; a fifth transistor having a first terminal coupled to a high voltage level, a second terminal coupled to the first node, and a gate terminal to receive a third control signal; a capacitor having a first terminal coupled to the third node, and a second terminal coupled to the fourth node; and a light-emitting device having a first terminal coupled to a low voltage level, and a second terminal coupled to the fourth node.

In one embodiment of the disclosure, the operation of the driving device is described in the following paragraph. At a first time point, the second control signal and the fourth control signal are at a low voltage logic level to turn off the third transistor and the fourth transistor, and the first control signal and the third control signal are at a high voltage logic level to turn on the second transistor and the fifth transistor. At a second time point, the second control signal is changed to the high voltage logic level to turn on the third transistor, and the third control signal is changed to the low voltage logic level to turn off the fourth transistor. At a third time point, the first control signal and the second control signal are changed to the low voltage logic level to turn off the second transistor and the third transistor, and the third control signal and the fourth control signal are changed to the high voltage logic level to turn on the fourth transistor and the fifth transistor.

Another embodiment of the disclosure provides a driving device comprising five NMOS transistors and two capacitors. The driving device comprises a first transistor having a first terminal coupled to a first node, a second terminal coupled to a second node, and a gate terminal coupled to a third node; a second transistor having a first terminal coupled to the first node, a second terminal coupled to the third node, and a gate terminal to receive a first control signal; a third transistor having a first terminal coupled to the second node, a second terminal to receive a display signal, and a gate terminal to receive a second control signal; a fourth transistor having a first terminal coupled to a fourth node, a second terminal coupled to the second node, and a gate terminal to receive a fourth control signal; a fifth transistor having a first terminal coupled to a high voltage level, a second terminal coupled to the first node, and a gate terminal to receive a third control signal; a first capacitor having a first terminal coupled to the high voltage level, and a second terminal coupled to the third node; a second capacitor having a first terminal coupled to the third node, and a second terminal coupled to the fourth node; and a light-emitting device having a first terminal coupled to a low voltage level and a second terminal coupled to the fourth node.

In one embodiment of the disclosure, the operation of the driving device is described in the following paragraph. At a first time point, the second control signal and the fourth control signal are at a low voltage logic level to turn off the third transistor and the fourth transistor, and the first control signal and the third control signal are at a high voltage logic level to turn on the second transistor and the fifth transistor. At a second time point, the second control signal is changed to the high voltage logic level to turn on the third transistor, and the third control signal is changed to the low voltage logic level to turn off the fifth transistor. At a third time point, the first control signal and the second control signal are changed to the low voltage logic level to turn off the second transistor and the third transistor, and the third control signal and the fourth control signal are changed to the high voltage logic level to turn on the fourth transistor and the fifth transistor.

Another embodiment of the disclosure provides a driving device comprising five NMOS transistors and two capacitors. The driving device comprises a first transistor having a first terminal coupled to a first node, a second terminal coupled to a second node, and a gate terminal coupled to a third node; a second transistor having a first terminal coupled to the first node, a second terminal coupled to the third node, and a gate terminal to receive a first control signal; a third transistor having a first terminal coupled to the second node, a second terminal to receive a display signal, and a gate terminal to receive a second control signal; a fourth transistor having a first terminal coupled to a fourth node, a second terminal coupled to the second node, and a gate terminal to receive a fourth control signal; a fifth transistor having a first terminal coupled to a high voltage level, a second terminal coupled to the first node, and a gate terminal to receive a third control signal; a first capacitor having a first terminal coupled to the high voltage level, and a second terminal coupled to the third node; a second capacitor having a first terminal coupled to the third node, and a second terminal coupled to the second node; and a light-emitting device having a first terminal coupled to a low voltage level and a second terminal coupled to the fourth node.

In one embodiment of the disclosure, the operation of the driving device is described in the following paragraph. At a first time point, the second control signal and the fourth control signal are at a low voltage logic level to turn off the third transistor and the fourth transistor, and the first control signal and the third control signal are at a high voltage logic level to turn on the second transistor and the fifth transistor. At a second time point, the second control signal is changed to the high voltage logic level to turn on the third transistor, and the third control signal is changed to the low voltage logic level to turn off the fifth transistor. At a third time point, the first control signal and the second control signal are changed to the low voltage logic level to turn off the second transistor and the third transistor, and the third control signal and the fourth control signal are changed to the high voltage logic level to turn on the fourth transistor and the fifth transistor.

A detailed description is given in the following embodiments with reference to the accompanying drawings.

BRIEF DESCRIPTION OF THE DRAWINGS

The disclosure can be more fully understood by reading the subsequent detailed description and examples with references made to the accompanying drawings, wherein.

DETAILED DESCRIPTION OF THE INVENTION

The following description is of the contemplated mode of carrying out the disclosure. This description is made for the purpose of illustrating the general principles of the disclosure and should not be taken in a limiting sense. The scope of the disclosure is determined by reference to the appended claims.

Figure 1:
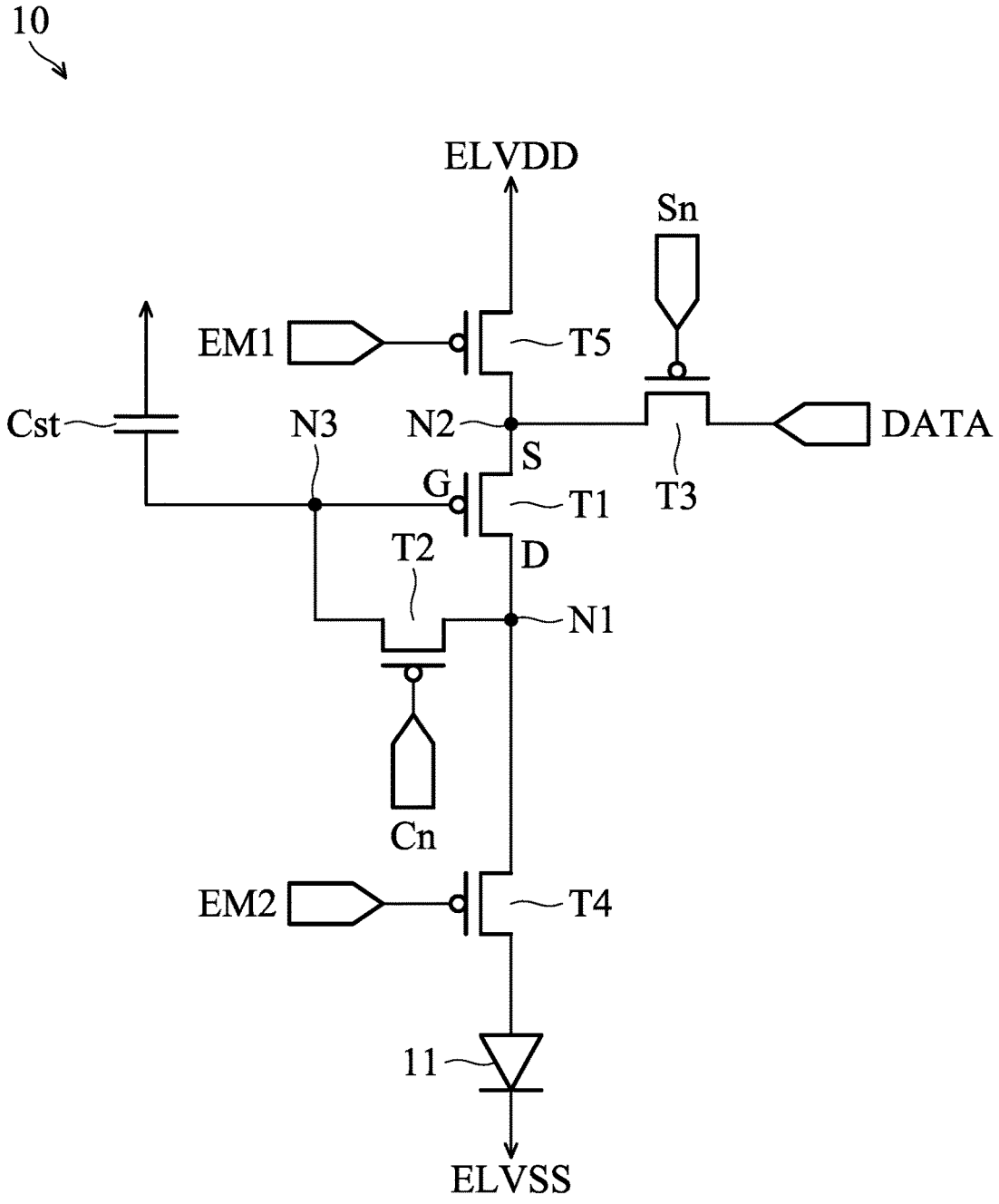
FIG. 1 is a circuit diagram of a driving device according to an embodiment of the disclosure.

FIG. 1 is a circuit diagram of a driving device according to an embodiment of the disclosure. The driving device shown in FIG. 1 is implemented by PMOS transistors to drive a light-emitting element 11. The light-emitting device 11 may be a light-emitting diode (LED), an organic light-emitting diode (OLED) or another light-emitting device. The driving device 10 is made up of five transistors and one capacitor, and the structure can increase the aperture rate of the display devices. Details of the driving device 10 are described in the following paragraph.

The first transistor T1 has a first terminal (labeled as D in FIG. 1) coupled to a first node N1, a second terminal (labeled as S in FIG. 1) coupled to a second node N2, and a gate terminal (labeled as G in FIG. 1) coupled to a third node N3. The second transistor T2 has a first terminal coupled to the first node N1, a second terminal coupled to a third node N3, and a gate terminal to receive a first control signal Cn. The third transistor T3 has a first terminal coupled to the second node N2, a second terminal to receive a display signal DATA, and a gate terminal to receive a second control signal Sn. The fourth transistor T4 has a first terminal coupled to a light-emitting element 11, a second terminal coupled to the first node N1, and a gate terminal to receive a third control signal EM2. The fifth transistor T5 has a first terminal coupled to a high voltage level ELVDD, a second terminal coupled to the second node N2, and a gate terminal to receive a fourth control signal EM1. The capacitor has a first terminal coupled to the high voltage level ELVDD or a DV voltage level, and a second terminal coupled to the third node N3. The light-emitting element 11 has a first terminal coupled to a low voltage level ELVSS and a second terminal coupled to the first terminal of the fourth transistor T4.

In this embodiment, the first transistor T1 is a driving transistor for driving the light-emitting element 11. The second transistor T2 is a compensation transistor to compensate for a threshold voltage (Vtp) shift. The third transistor T3 is a data input transistor for receiving an input image signal DATA. In this embodiment, the image signal DATA is in form of current or voltage. The fourth transistor T4 and the fifth transistor T5 are switch transistors to determine whether the light-emitting element 11 is to be enabled.

Figure 2A:
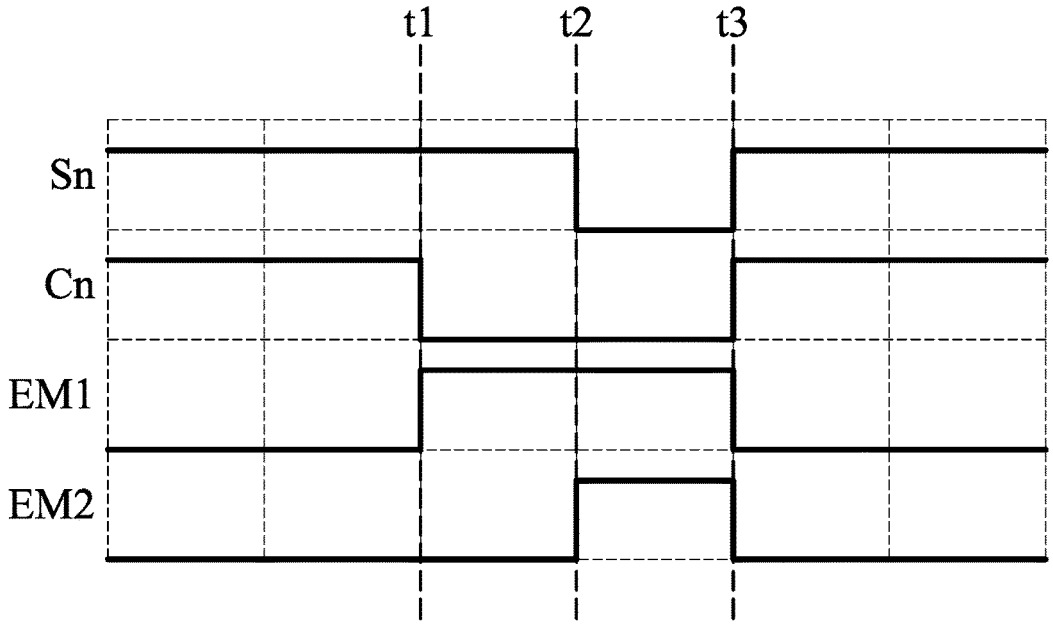
FIG. 2A is a waveform of an embodiment of the operation of the driving device in FIG. 1.

FIG. 2A is a waveform of an embodiment of the operation of the driving device in FIG. 1. Generally speaking, the operation of the driving device comprises three stages. The first stage is a reset period. The first transistor T1 is turned on to pull down a voltage level of the second terminal of the first transistor T1 to voltage level ELVSS (ground). The second stage is a compensation period. The third transistor T3 is turned on to receive the image signal DATA, and the second transistor T2 is turned on to compensate for the image signal DATA. The third stage is a display period. The image signal DATA is stored in the capacitor Cst via the first transistor T1 and displayed by the light-emitting element 11.

At a first time point t1, the second control signal Sn and the fourth control signal EM1 are at a high voltage logic level to turn off the third transistor T3 and the fifth transistor T5. The first control signal Cn and the third control signal EM2 are at a low voltage logic level to turn on the second transistor T2 and the fourth transistor T4. Meanwhile, the voltage level of the node N3 is pulled down to voltage level ELVSS (ground), the first transistor T1 is also turned on. The voltage level of node N2 is also pulled down to voltage level ELVSS (ground).

At a second time point t2, the second control signal Sn is changed to the low voltage logic level to turn on the third transistor T3, and the third control signal EM2 is changed to the high voltage logic level to turn off the fourth transistor T4. Due to the image signal DATA, the voltage level of gate terminal of the first transistor T1 is ($V_{DATA}$+$V_{tp}$).

At a third time point t3, the first control signal Cn and the second control signal Sn are changed to the high voltage logic level to turn off the second transistor T2 and the third transistor T3. The third control signal EM2 and the fourth control signal EM1 are changed to the low voltage logic level to turn on the fourth transistor T4 and the fifth transistor T5. The compensated image signal is stored in the capacitor Cst and displayed by the light-emitting element 11.

In this embodiment, the reset period is the duration between time t1 and t2, the compensation period is the duration between time t2 and time t3, and the display period is the duration after time t3.

To clearly illustrate the driving scheme of the embodiment, table I and table II may be referred to.

TABLE I

| | T1 | T2 | T3 | T4 | T5 |
|---|---|---|---|---|---|
| RESET | ON | ON | OFF | ON | OFF |
| COMPENSATION | ON | ON | ON | OFF | OFF |
| DISPLAY | ON | OFF | OFF | ON | ON |

TABLE II

| | G | S | $V_{GS}$ − $\lvert V_{tp}\rvert$ |
|---|---|---|---|
| RESET | ~ELVSS | floating | X |
| COMPENSATION | $V_{DATA}$ + $\lvert V_{tp}\rvert$ | $V_{DATA}$ | 0 |
| DISPLAY | $V_{DATA}$ + $\lvert V_{tp}\rvert$ | $V_{DD}$ | $V_{DATA}$ − $V_{DD}$ |

TABLE I shows the status of transistors of the driving device 10 at different time points. TABLE II shows the voltage levels of the second terminal and the gate terminal of the first transistor T1, and the voltage received by the light-emitting element 11. From TABLE II, it is found that the voltage received by the light-emitting element 11 is not affected by the threshold voltage of the first transistor T1.

Figure 2B:
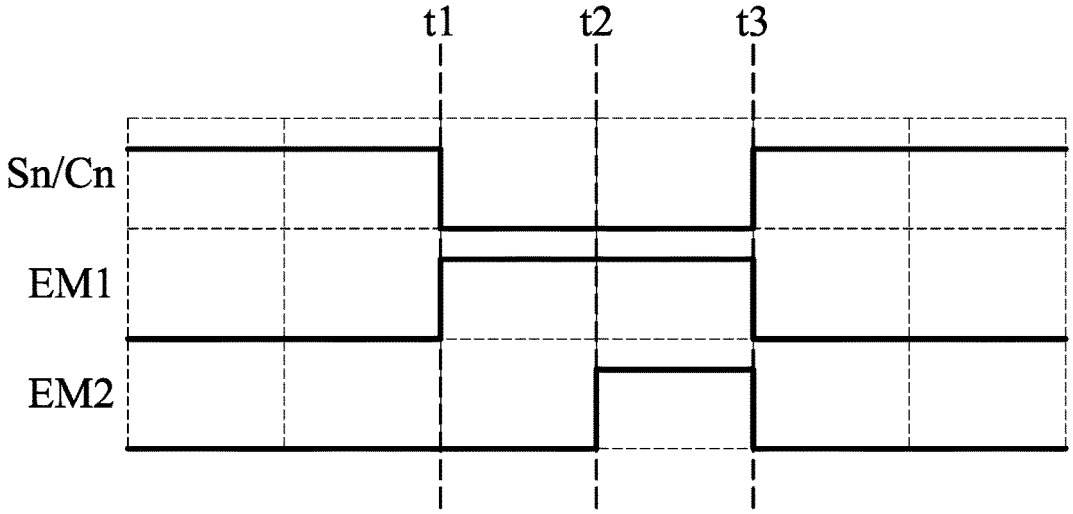
FIG. 2B is a waveform of another embodiment of the operation of the driving device in FIG. 1.

FIG. 2B is a waveform of another embodiment of the operation of the driving device in FIG. 1. Generally speaking, the operation of the driving device 11 comprises three stages. The first stage is a reset period. The first transistor T1 is turned on to pull down a voltage level of the second terminal of the first transistor T1 to voltage level ELVSS (ground). The second stage is a compensation period. The third transistor T3 is turned on to receive the image signal DATA, and the second transistor T2 is turned on to compensate for the image signal DATA. The third stage is a display period. The image signal DATA is stored in the capacitor Cst via the first transistor T1 and displayed by the light-emitting element 11. In this embodiment, the first control signal Cn and the second control signal Sn are implemented by one single control line.

In this embodiment, the first control signal Cn and the second control signal Sn are implemented by one single control line, i.e., the first control signal Cn and the second control signal Sn are the same. At a first time point t1, the first control signal Cn and the second control signal Sn are changed to a low voltage logic level, and the third control signal is at a low voltage logic level to turn on the second transistor T2, the third transistor T3 and the fourth transistor T4. Meanwhile, the first transistor T1 is also turned on. Although the image signal DATA is transmitted to the second terminal of the first transistor T1, the voltage level of the second terminal of the first transistor T1 is closed to ground level because the fourth transistor T4 is turned on.

At a second time point t2, the third control signal EM2 is changed to the high voltage logic level to turn off the fourth transistor T4. The voltage level of the gate terminal of the first transistor T1 is changed to ($V_{DATA}$+$V_{tp}$) due to the image signal DATA. At a third time point t3, the first control signal Cn and the second control signal Sn are changed to the high voltage logic level to turn off the second transistor T2 and the third transistor T3. The third control signal EM2 and the fourth control signal EM1 are changed to the low voltage logic level to turn on the fourth transistor T4 and the fifth transistor T5. The compensated image signal DATA is stored in the capacitor Cst and displayed by the light-emitting element 11.

In this embodiment, the reset period is the duration between time t1 and t2, the compensation period is the duration between time t2 and time t3, and the display period is the duration after time t3.

Figure 3A:
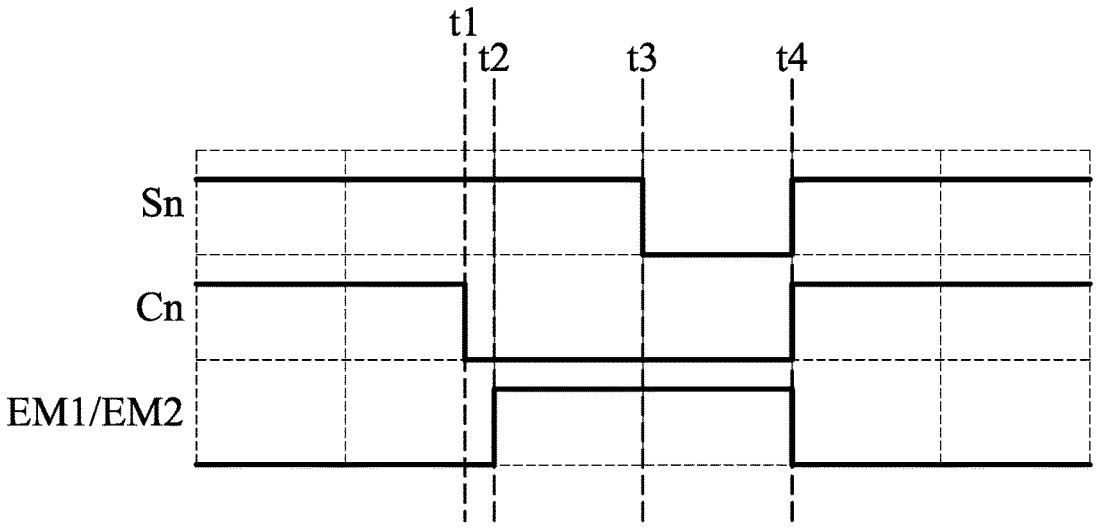
FIG. 3A is a waveform of another embodiment of the operation of the driving device in FIG. 1.

FIG. 3A is a waveform of another embodiment of the operation of the driving device in FIG. 1. Compared with FIG. 2A, the difference of the operation of the driving device 10 is that the third control signal EM2 and the fourth control signal EM1 are the same. It means that only one signal line is required for the third control signal EM2 and the fourth control signal EM1. Similarly, the operation of the driving device comprises three stages: a reset period, a compensation period, and a display period. During the reset period, the voltage level of the first terminal of the first transistor T1 and the third node is reset to the ground voltage level. During the compensation period, the image signal DATA is compensated for, and the compensated image signal DATA is stored in the capacitor Cst. During the display period, the compensated image signal DATA is displayed by the light-emitting element 11.

At a first time point t1, the second control signal Sn is at a high voltage logic level to turn off the third transistor T3. The first control signal Cn, the third control signal EM2 and the fourth control signal EM1 are at a low voltage logic level to turn on the second transistor T2, the fourth transistor T4 and the fifth transistor T5. Meanwhile, the first transistor T1 is also turned on. The high voltage ELVDD is transmitted to the light-emitting element 11 to turn on the light-emitting element 11. At a second time point t2, the third control signal EM2 and the fourth control signal EM1 are changed to the high voltage logic level to turn off the fourth transistor T4 and the fifth transistor T5.

At a third time point t3, the second control signal Sn is changed to the low voltage logic level, and the image signal DATA is transmitted to the first transistor T1, wherein the voltage level of the gate terminal of the first transistor T1 is changed to ($V_{DATA}$+$V_{tp}$). At a fourth time point t4, the first control signal Cn and the second control signal Sn is changed to the high voltage logic level to turn off the second transistor T2 and the third transistor T3. The third control signal EM2 and the fourth control signal EM1 are changed to the low voltage logic level. The compensated image signal DATA is stored in the capacitor Cst and displayed by the light-emitting element 11.

In this embodiment, the reset period is the duration between time t1 and t3, the compensation period is the duration between time t3 and time t4, and the display period is the duration after time t4. In another embodiment, the difference between time point t1 and time point t2 is adjustable.

Figure 3B:
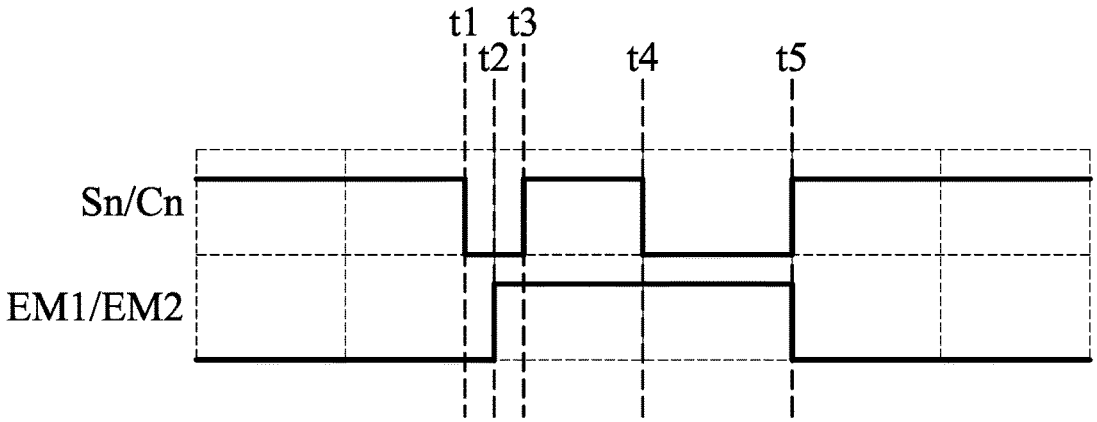
FIG. 3B is a waveform of another embodiment of the operation of the driving device in FIG. 1.

FIG. 3B is a waveform of another embodiment of the operation of the driving device in FIG. 1. Compared with the operation flow of FIG. 3A, the first control signal Cn and the second control signal Sn are the same in FIG. 3B. Therefore, in the operation flow of FIG. 3B, only two signal lines are required to control the driving device 10. This can reduce the complexity of the circuit control. Similarly, the operation of the driving device comprises three stages: a reset period, a compensation period, and a display period. During the reset period, the voltage level of the first terminal of the first transistor T1 and the third node N3 is reset to the ground voltage level. During the compensation period, the image signal DATA is compensated for, and the compensated image signal DATA is stored in the capacitor Cst. During the display period, the compensated image signal DATA is displayed by the light-emitting element 11. At a first time point t1, the first control signal Cn, the second control signal Sn, the third control signal EM2 and the fourth control signal EM1 are at a low voltage logic level to turn on transistors T1~T5. Meanwhile, the voltage level of nodes N1, N2 or N3 is pulled down to voltage level ELVSS (ground).

At a second time point t2, the third control signal EM2 and the fourth control signal EM1 are changed to a high voltage logic level to turn off the fourth transistor T4 and the fifth transistor T5. At a third time point t3, the first control signal Cn and the second control signal Sn are changed to the high voltage logic level to turn off the second transistor T2 and the third transistor T3. At a fourth time point t4, the first control signal Cn and the second control signal Sn are changed to the low voltage logic level to turn on the second transistor T2 and the third transistor T3. Meanwhile, the voltage level of the gate terminal of the first transistor T1 is ($V_{DATA}$+$V_{tp}$). At a fifth time point t5, the first control signal Cn and the second control signal Sn are changed to the high voltage logic level to turn off the second transistor T2 and the third transistor T3. The third control signal EM2 and the fourth control signal EM1 are changed to the low voltage logic level to turn on the fourth transistor T4 and the fifth transistor T5. Meanwhile, the compensated image signal DATA is displayed by the light-emitting element 11.

In this embodiment, the reset period is the duration between time t1 and t4, the compensation period is the duration between time t4 and time t5, and the display period is the duration after time t5. In another embodiment, the difference between time point t1 and time point t2 is adjustable. Although the operation flow shown in FIG. 3B causes the light-emitting element 11 to be lighted up between time point t1 and time point t2, the duration between time point t1 and time point t2 is short and can be ignored.

Figure 4:
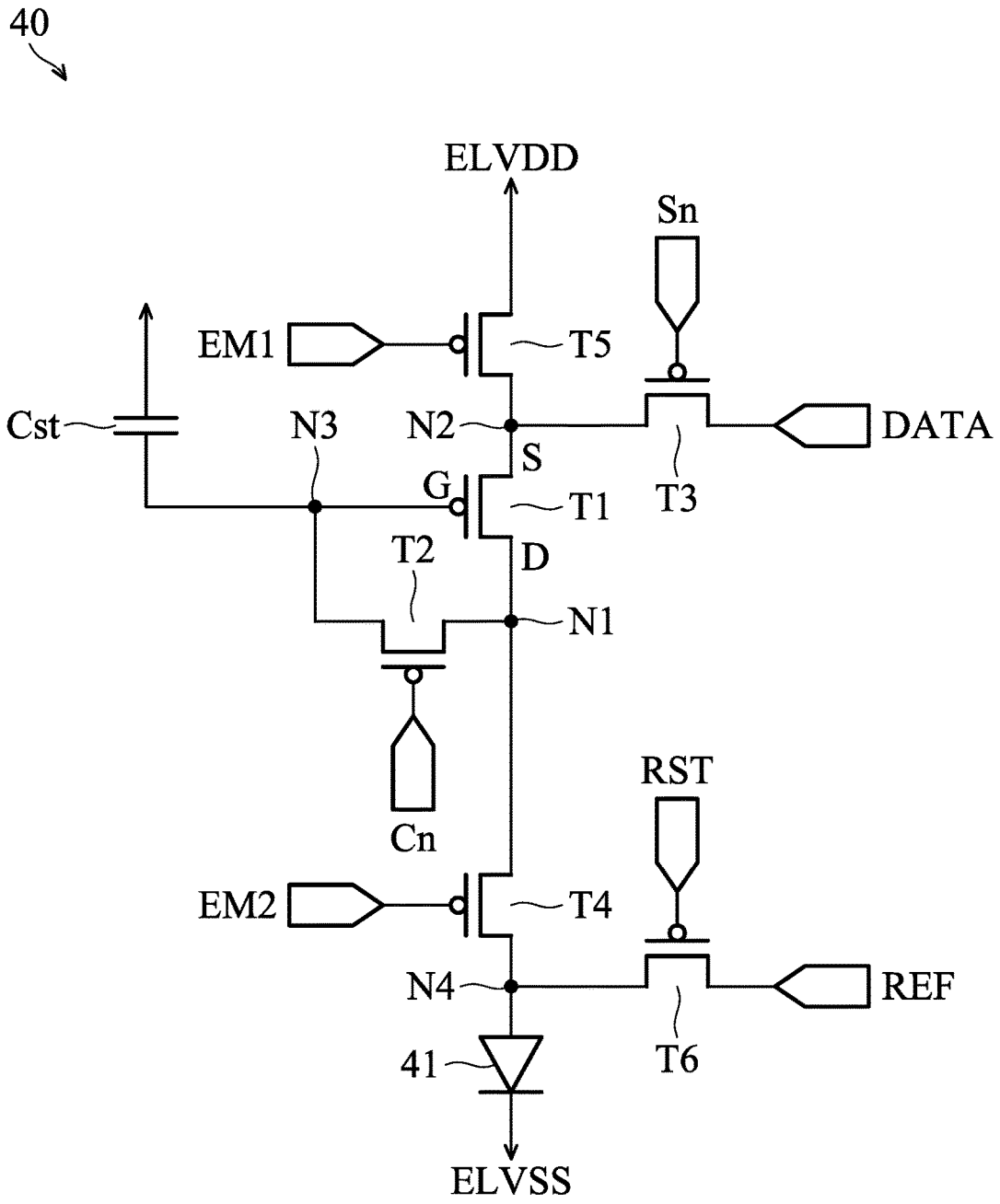
FIG. 4 is a circuit diagram of a driving device according to another embodiment of the disclosure.

FIG. 4 is a circuit diagram of a driving device according to another embodiment of the disclosure. The driving device of FIG. 4 is made up of PMOS transistors to drive a light-emitting element 41. The light-emitting device 41 may be a light-emitting diode (LED), an organic light-emitting diode (OLED) or another light-emitting device. The driving device 40 is made up of six transistors and one capacitor, and the structure can increase the aperture rate of the display devices. Details of the driving device 40 are described in the following paragraph.

The first transistor T1 has a first terminal (labeled as D in FIG. 1) coupled to a first node N1, a second terminal (labeled as S in FIG. 1) coupled to a second node N2, and a gate terminal (labeled as G in FIG. 1) coupled to a third node N3. The second transistor T2 has a first terminal coupled to the first node N1, a second terminal coupled to a third node N3, and a gate terminal to receive a first control signal Cn. The third transistor T3 has a first terminal coupled to the second node N2, a second terminal to receive a display signal DATA, and a gate terminal to receive a second control signal Sn. The fourth transistor T4 has a first terminal coupled to a fourth node N4, a second terminal coupled to the first node N1, and a gate terminal to receive a third control signal EM2. The fifth transistor T5 has a first terminal coupled to a high voltage level ELVDD, a second terminal coupled to the second node N2, and a gate terminal to receive a fourth control signal EM1. The sixth transistor T6 has a first terminal to receive a reference voltage $V_{REF}$, a second terminal coupled to the fourth node N4, and a gate terminal to receive a reset signal RST. The capacitor Cst has a first terminal coupled to the high voltage level ELVDD, and a second terminal coupled to the third node N3. The light-emitting element 41 has a first terminal coupled to a low voltage level ELVSS, and a second terminal coupled to the fourth node N4.

In this embodiment, the first transistor T1 is a driving transistor for driving the light-emitting element 41. The second transistor T2 is a compensation transistor to compensate for a threshold voltage (Vtp) shift of the first transistor T1. The third transistor T3 is a data input transistor for receiving an input image signal DATA. In this embodiment, the image signal DATA is in form of current or voltage. The fourth transistor T4 and the fifth transistor T5 are switch transistors to determine whether the light-emitting element 41 is to be enabled. The sixth transistor T6 is a reset transistor to reset the voltage level of the first node N1 to be the reference voltage $V_{REF}$.

Figure 5A:
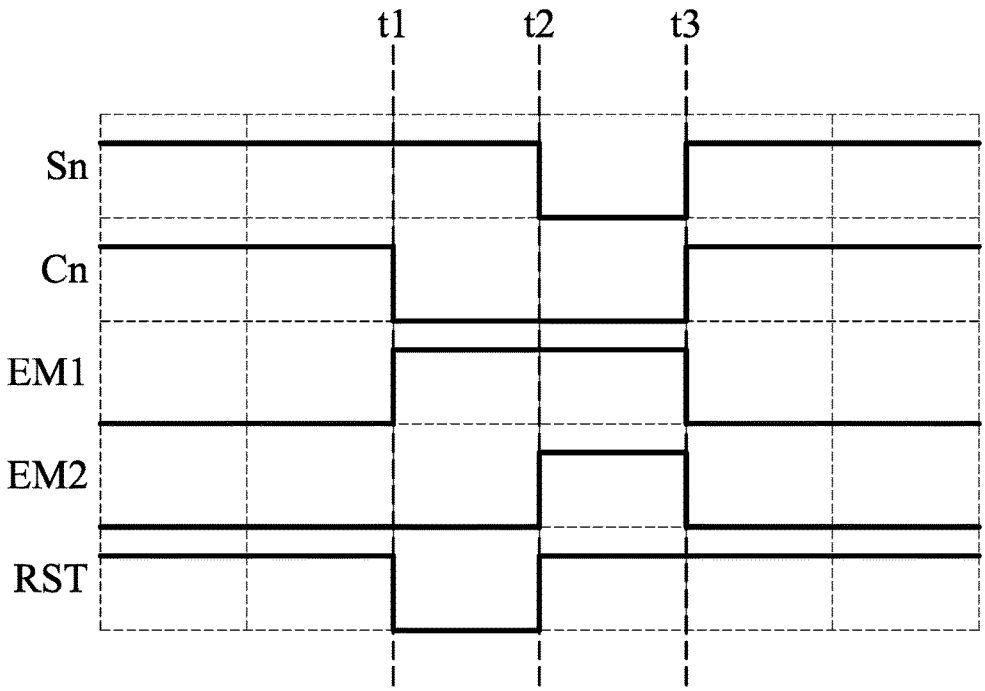
FIG. 5A is a waveform of an embodiment of the operation of the driving device in FIG. 4.

FIG. 5A is a waveform of an embodiment of the operation of the driving device in FIG. 4. Generally speaking, the operation of the driving device comprises three stages: a reset period, a compensation period, and a display period. During the reset period, the first transistor T1 is turned on to pull the voltage level of the second terminal of the first transistor T1 and the third node is reset to voltage level ELVSS (ground voltage level). During the compensation period, the third transistor T3 is turned on to receive the display signal DATA. The second transistor T2 is turned on to compensate for the image signal DATA. The compensated image signal DATA is stored in the capacitor Cst. During the display period, the compensated image signal DATA is displayed by the light-emitting element 41.

At a first time point t1, the second control signal Sn and the fourth control signal EM1 are at a high voltage logic level to turn off the third transistor T3 and the fifth transistor T5. The reset signal RST, the first control signal Cn and the third control signal EM2 are at a low voltage logic level to turn on the sixth transistor T6, the second transistor T2 and the fourth transistor T4. Meanwhile, the first transistor T1 is also turned on due to the turned-on second transistor T2 and fourth transistor T4. The voltage level of the first terminal of the first transistor T1 and the third node N3 is set to be the same as the reference voltage $V_{REF}$.

At a second time point t2, the second control signal Sn is changed to the low voltage logic level to turn on the third transistor T3. The third control signal EM2 and the reset signal RST are changed to the high voltage logic level to turn off the fourth transistor T4 and the sixth transistor T6. Meanwhile, The voltage level of the first terminal of the first transistor T1 is changed to ($V_{DATA}$+$V_{tp}$).

At a third time point t3, the first control signal Cn and the second control signal Sn are changed to the high voltage logic level to turn off the second transistor T2 and the third transistor T3. The third control signal EM2 and the fourth control signal EM1 are changed to the low voltage logic level to turn on the fourth transistor T4 and the fifth transistor T5. Meanwhile, the compensated image signal DATA is stored in the capacitor Cst and displayed by the light-emitting element 41. In this embodiment, the reset period is the duration between time t1 and t2, the compensation period is the duration between time t2 and time t3, and the display period is the duration after time t3.

To clearly illustrate the driving scheme of the embodiment, table III and table IV may be referred to.

TABLE III

| | T1 | T2 | T3 | T4 | T5 | T6 |
|---|---|---|---|---|---|---|
| RESET | ON | ON | OFF | ON | OFF | ON |
| COMPENSATION | ON | ON | ON | OFF | OFF | OFF |
| DISPLAY | ON | OFF | OFF | ON | ON | OFF |

TABLE IV

| | G | S | $V_{GS}$ − $\lvert V_{tp}\rvert$ |
|---|---|---|---|
| RESET | ~ELVSS | floating | X |
| COMPENSATION | $V_{DATA}$ + $\lvert V_{tp}\rvert$ | $V_{DATA}$ | 0 |
| DISPLAY | $V_{DATA}$ + $\lvert V_{tp}\rvert$ | $V_{DD}$ | $V_{DATA}$ − $V_{DD}$ |

TABLE III shows the status of transistors of the driving device 40 at different time points. TABLE IV shows the voltage levels of the second terminal and the gate terminal of the first transistor T1, and the voltage received by the light-emitting element 41. From TABLE IV, it is found that the voltage received by the light-emitting element 41 is not affected by the threshold voltage of the first transistor T1 during the display period.

Figure 5B:
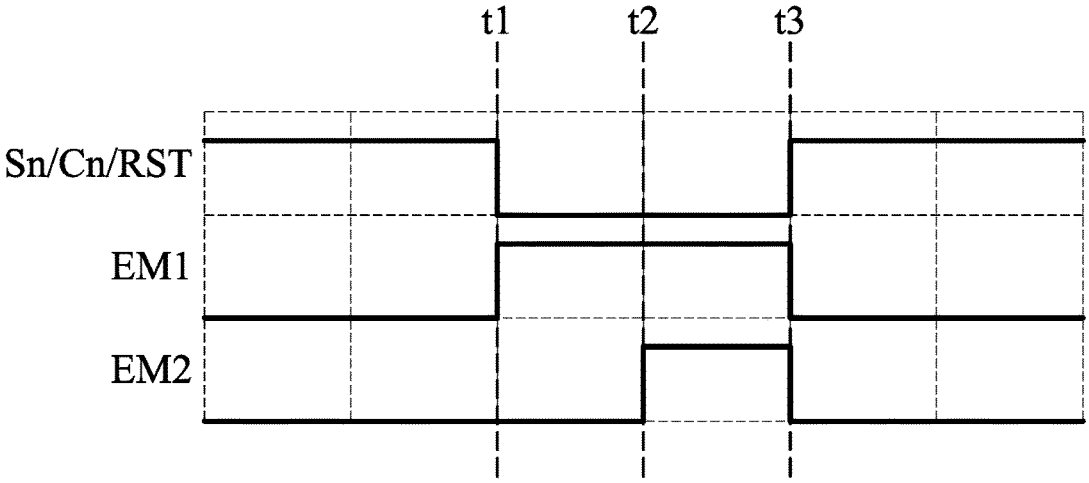
FIG. 5B is a waveform of another embodiment of the operation of the driving device in FIG. 4.

FIG. 5B is a waveform of another embodiment of the operation of the driving device in FIG. 4. Compared with the operation flow shown in FIG. 5A, the reset signal RST, the first control signal Cn and the second control signal Sn are the same in this embodiment.

At time point t1, only the fourth control signal EM1 is at a high voltage logic level, i.e., only the fifth transistor T5 is turned off. At time point t2, the third control signal EM2 is changed to the high voltage logic level and the fourth transistor T4 is turned off accordingly. Meanwhile, the voltage level of the first terminal of the first transistor T1 is changed to ($V_{DATA}$+$V_{tp}$). At time point t3, only the third control signal EM2 and the fourth control signal EM1 are at a low voltage logic level, the compensated image signal DATA is stored in the capacitor Cst and displayed by the light-emitting element 41. In this embodiment, the reset period is the duration between time t1 and t2, the compensation period is the duration between time t2 and time t3, and the display period is the duration after time t3.

Figure 6A:
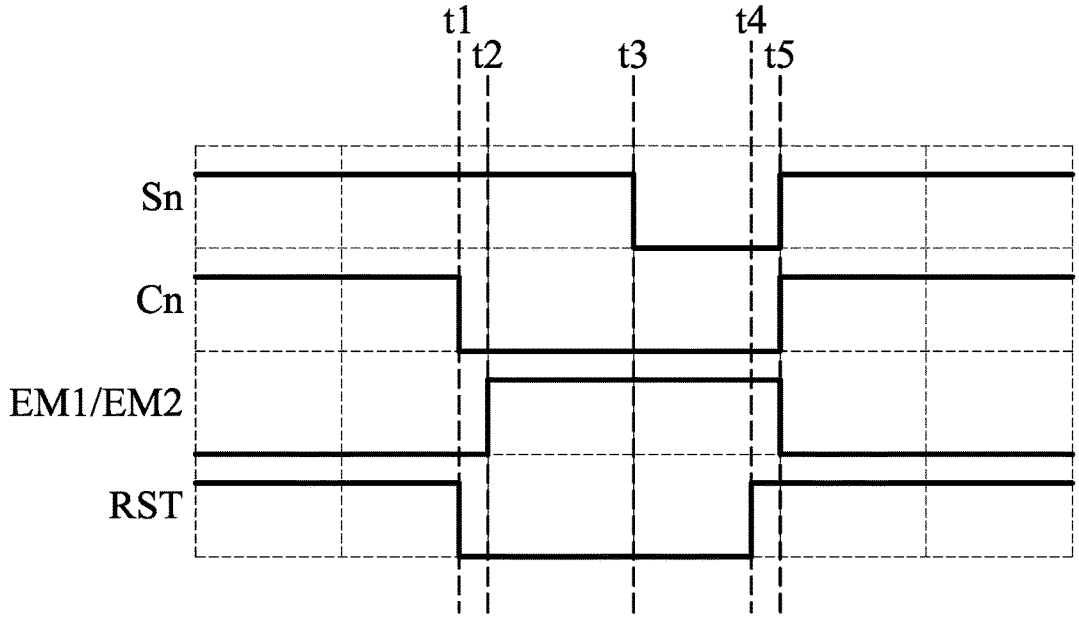
FIG. 6A is a waveform of another embodiment of the operation of the driving device in FIG. 4.

FIG. 6A is a waveform of another embodiment of the operation of the driving device in FIG. 4. Generally speaking, the operation of the driving device comprises three stages: a reset period, a compensation period, and a display period. During the reset period, the first transistor T1 is turned on, and the voltage level of the first terminal of the first transistor T1 is pulled down to voltage level ELVSS (ground). During the compensation period, the third transistor T3 is turned on to receive the image signal DATA, and the second transistor T2 is turned on to compensate for the image signal DATA. During the display period, the compensated image signal DATA is stored in the capacitor Cst and displayed by the light-emitting element 41.

Compared with FIG. 5A, the difference of the operation flow of the driving device 40 is that the third control signal EM2 and the fourth control signal EM1 are the same. It means that only one signal line is required for the third control signal EM2 and the fourth control signal EM1. Similarly, the operation of the driving device comprises three stages: a reset period, a compensation period, and a display period. During the reset period, the voltage level of the first terminal of the first transistor T1 is reset to the ground voltage level. During the compensation period, the image signal DATA is compensated for, and the compensated image signal DATA is stored in the capacitor Cst. During the display period, the compensated image signal DATA is displayed by the light-emitting element 41.

At a first time point t1, the second control signal Sn is at a high voltage logic level to turn off the third transistor T3. The reset signal RST, the first control signal Cn, the third control signal EM2 and the fourth control signal EM1 are at a low voltage logic level to turn on the sixth transistor T6, the second transistor T2, the fourth transistor T4 and the fifth transistor T5. Meanwhile, the first transistor T1 is also turned on. The high voltage ELVDD is transmitted to the light-emitting element 41 to turn on the light-emitting element 41. At a second time point t2, the third control signal EM2 and the fourth control signal EM1 are changed to the high voltage logic level to turn off the fourth transistor T4 and the fifth transistor T5. Although the operation flow shown in FIG. 5A causes the light-emitting element 41 to be lighted up between time point t1 and time point t2, the duration between time point t1 and time point t2 is short and can be ignored.

At a third time point t3, the second control signal Sn is changed to the low voltage logic level, and the image signal DATA is transmitted to the first transistor T1, wherein the voltage level of the gate terminal of the first transistor T1 is changed to ($V_{DATA}+V_{tp}$). At a fourth time point t4, the reset signal RST is changed to the high voltage logic level to turn off the sixth transistor T6. At a fifth time point, the third control signal EM2 and the fourth control signal EM1 are changed to the low voltage logic level to turn on the fourth transistor T4 and the fifth transistor T5. Meanwhile, the first control signal Cn and the second control signal Sn is changed to the high voltage logic level to turn off the second transistor T2 and the third transistor T3. The compensated image signal DATA is stored in the capacitor Cst and displayed by the light-emitting element 41.

In this embodiment, the reset period is the duration between time t1 and t3, the compensation period is the duration between time t3 and time t5, and the display period is the duration after time t5. In another embodiment, the difference between time point t1 and time point t2 is adjustable.

Figure 6B:
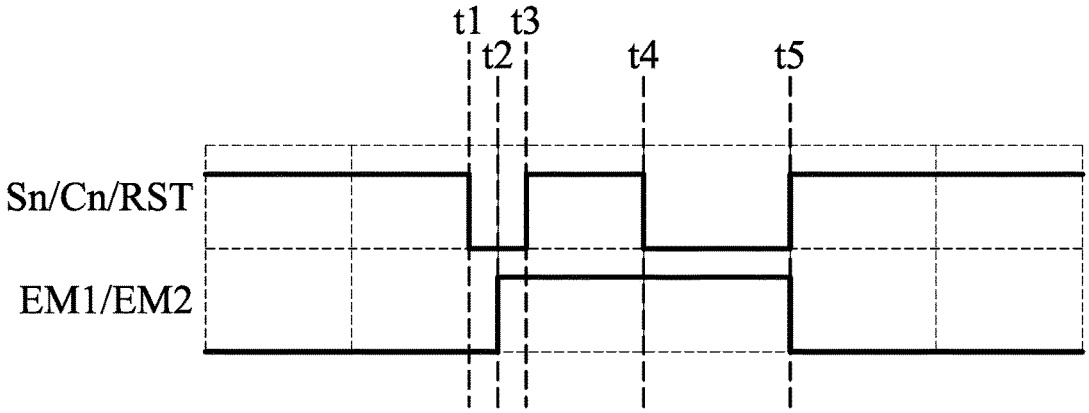
FIG. 6B is a waveform of another embodiment of the operation of the driving device in FIG. 4.

FIG. 6B is a waveform of another embodiment of the operation of the driving device in FIG. 4. Compared with the operation flow of FIG. 6A, the first control signal Cn and the second control signal Sn are the same in this embodiment. Therefore, in the operation flow of FIG. 6B, only two signal lines are required to control the driving device 10. This can reduce the complexity of the circuit control. Similarly, the operation of the driving device comprises three stages: a reset period, a compensation period, and a display period. During the reset period, the voltage level of the first terminal of the first transistor T1 and the third node N3 is reset to the ground voltage level. During the compensation period, the image signal DATA is compensated for, and the compensated image signal DATA is stored in the capacitor Cst. During the display period, the compensated image signal DATA is displayed by the light-emitting element 41.

At a first time point t1, all control signals are at a low voltage logic level, thus, all transistors are turned on accordingly. At a second time point t2, the third control signal EM2 and the fourth control signal EM1 are changed to a high voltage logic level to turn off the fourth transistor T4 and the fifth transistor T5. Meanwhile, the light-emitting element 41 stops emitting light. At a third time point t3, the first control signal Cn and the second control signal Sn are changed to the high voltage logic level to turn off the second transistor T2 and the third transistor T3.

At a fourth time point t4, the first control signal Cn and the second control signal Sn are changed to the low voltage logic level to turn on the second transistor T2 and the third transistor T3. Meanwhile, the voltage level of the gate terminal of the first transistor T1 is ($V_{DATA}+V_{tp}$). At a fifth time point t5, the first control signal Cn and the second control signal Sn are changed to the high voltage logic level to turn off the second transistor T2 and the third transistor T3. The third control signal EM2 and the fourth control signal EM1 are changed to the low voltage logic level to turn on the fourth transistor T4 and the fifth transistor T5. Meanwhile, the compensated image signal DATA is stored in the capacitor Cst and displayed by the light-emitting element 11.

In this embodiment, the reset period is the duration between time t1 and t4, the compensation period is the duration between time t4 and time t5, and the display period is the duration after time t5. In another embodiment, the difference between time point t1 and time point t2 is adjustable. Although the operation flow shown in FIG. 6B causes the light-emitting element 41 to be lighted up between time point t1 and time point t2, the duration between time point t1 and time point t2 is short and can be ignored.

Figure 7:
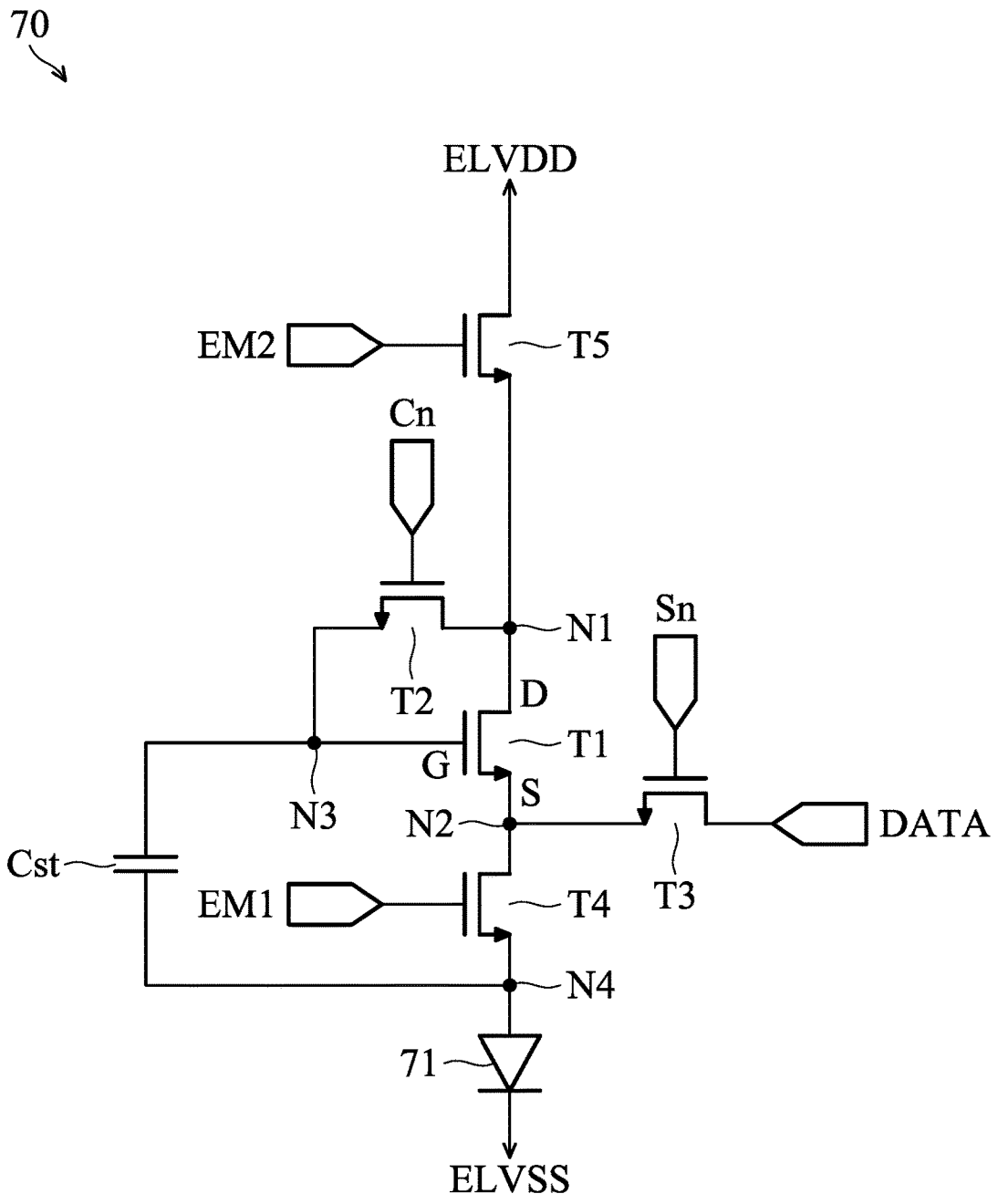
FIG. 7 is a circuit diagram of a driving device according to another embodiment of the disclosure.

FIG. 7 is a circuit diagram of a driving device according to another embodiment of the disclosure. The driving device of FIG. 7 is made up of NMOS transistors to drive a light-emitting element 71. The light-emitting device 70 may be a light-emitting diode (LED), an organic light-emitting diode (OLED) or another light-emitting device. The driving device 70 is made up of five transistors and one capacitor, and the structure can increase the aperture rate of the display devices. The details of the driving device 70 are described in the following paragraph.

The first transistor T1 has a first terminal (labeled as D in FIG. 1) coupled to a first node N1, a second terminal (labeled as S in FIG. 1) coupled to a second node N2, and a gate terminal (labeled as G in FIG. 1) coupled to a third node N3. The second transistor T2 has a first terminal coupled to the first node N1, a second terminal coupled to a third node N3, and a gate terminal to receive a first control signal Cn. The third transistor T3 has a first terminal coupled to the second node N2, a second terminal to receive a display signal DATA, and a gate terminal to receive a second control signal Sn. The fourth transistor T4 has a first terminal coupled to a fourth node N4, a second terminal coupled to the second node N1, and a gate terminal to receive a fourth control signal EM1. The fifth transistor T5 has a first terminal coupled to a high voltage level ELVDD, a second terminal coupled to the first node N1, and a gate terminal to receive a third control signal EM2. The capacitor has a first terminal coupled to the third node N3, and a second terminal coupled to the fourth node N4. The light-emitting element 71 has a first terminal coupled to a low voltage level ELVSS and a second terminal coupled to the fourth node N4.

In this embodiment, the first transistor T1 is a driving transistor for driving the light-emitting element 71. The second transistor T2 is a compensation transistor to compensate for a threshold voltage (Vtp) shift of the first transistor T1. The third transistor T3 is a data input transistor for receiving an input image signal DATA. In this embodiment, the image signal DATA is in form of current or voltage. The fourth transistor T4 and the fifth transistor T5 are switch transistors to determine whether the light-emitting element 71 is to be enabled.

Figure 8:
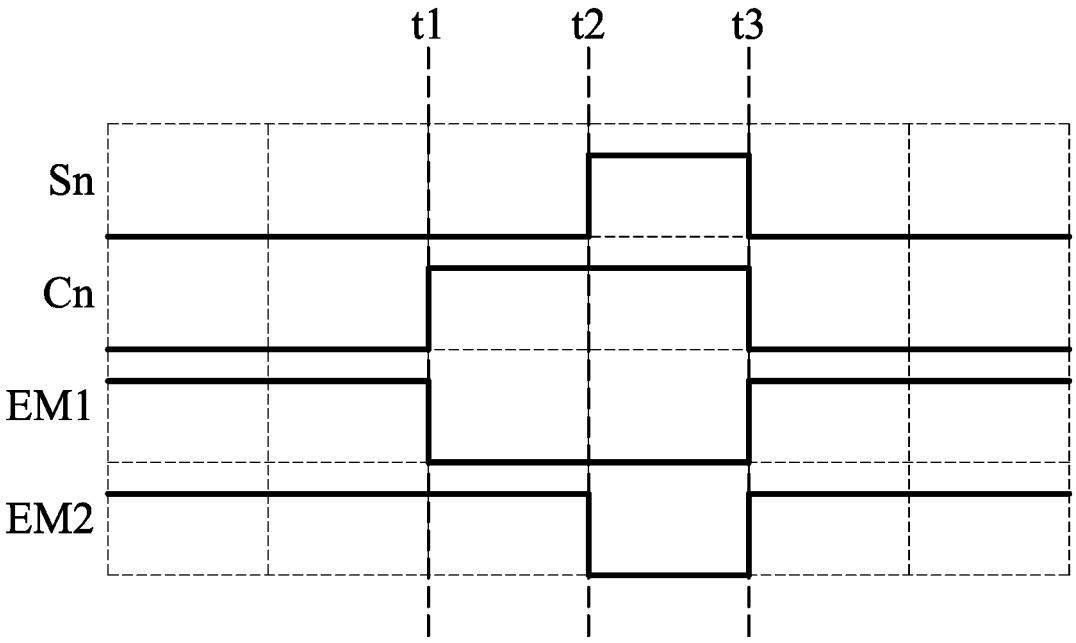
FIG. 8 is a waveform of an embodiment of the operation of the driving device in FIG. 7.

FIG. 8 is a waveform of an embodiment of the operation of the driving device in FIG. 7. Before receiving the image signal DATA, the driving device 70 resets the first transistor T1 by the first control signal Cn and the third control signal EM2. When receiving the image signal DATA, the fourth transistor T4 is not turned accordingly. The image signal DATA is first compensated for by the second transistor T2, and then the compensated image signal DATA is stored in the capacitor Cst. After the image signal DATA is compensated for, the fourth transistor T4 and the fifth transistor T5 are turned on, and the compensated image signal DATA is transmitted to the light-emitting element 71.

At a first time point t1, the second control signal Sn and the fourth control signal EM1 are at a low voltage logic level to turn off the third transistor T3 and the fourth transistor T4. The first control signal Cn and the third control signal EM2 are at a high voltage logic level to turn on the second transistor T2 and the fifth transistor T5. Meanwhile, the voltage level of the third node N3 is pulled up to voltage level ELVDD (high voltage level), and the first transistor T1 is turned on accordingly.

At a second time point t2, the second control signal Sn is changed to the high voltage logic level to turn on the third transistor T3, and the third control signal EM2 is changed to the low voltage logic level to turn off the fifth transistor T5. The voltage level of the gate terminal of the first transistor T1 is changed to ($V_{DATA}$+$V_{tp}$) due to the image signal DATA.

At a third time point t3, the first control signal Cn and the second control signal Sn are changed to the low voltage logic level to turn off the second transistor T2 and the third transistor T3. The third control signal EM2 and the fourth control signal EM1 are changed to the high voltage logic level to turn on the fourth transistor T4 and the fifth transistor T5. The compensated image signal DATA is stored in the capacitor Cst and displayed the light-emitting element 71.

In this embodiment, the reset period is the duration between time t1 and t2, the compensation period is the duration between time t2 and time t3, and the display period is the duration after time t3.

To clearly illustrate the driving scheme of the embodiment, table V and table VI may be referred to.

TABLE V

| | T1 | T2 | T3 | T4 | T5 |
|---|---|---|---|---|---|
| RESET | ON | ON | OFF | OFF | ON |
| COMPENSATION | ON | ON | ON | OFF | OFF |
| DISPLAY | ON | OFF | OFF | ON | ON |

TABLE VI

| | G | S | $V_{GS} - \lvert V_{tn} \rvert$ |
|---|---|---|---|
| RESET | VDD | floating | X |
| COMPENSATION | $V_{DATA} + V_{tn}$ | $V_{DATA}$ | 0 |
| DISPLAY | $V_{DATA} + V_{tn}$ | $V_{SS} + V_{oled}$ | $V_{DATA} - (V_{SS} + V_{oled})$ |

TABLE V shows the status of transistors of the driving device 70 at different time points. TABLE VI shows the voltage level of the second terminal and the gate terminal of the first transistor T1, and the voltage received by the light-emitting element 71. From TABLE VI, it is found that the voltage received by the light-emitting element 71 is not affected by the threshold voltage of the first transistor T1 during the display period (after time point t3). In table VI, the $V_{oled}$ is the threshold voltage of the light-emitting element 71.

Figure 9:
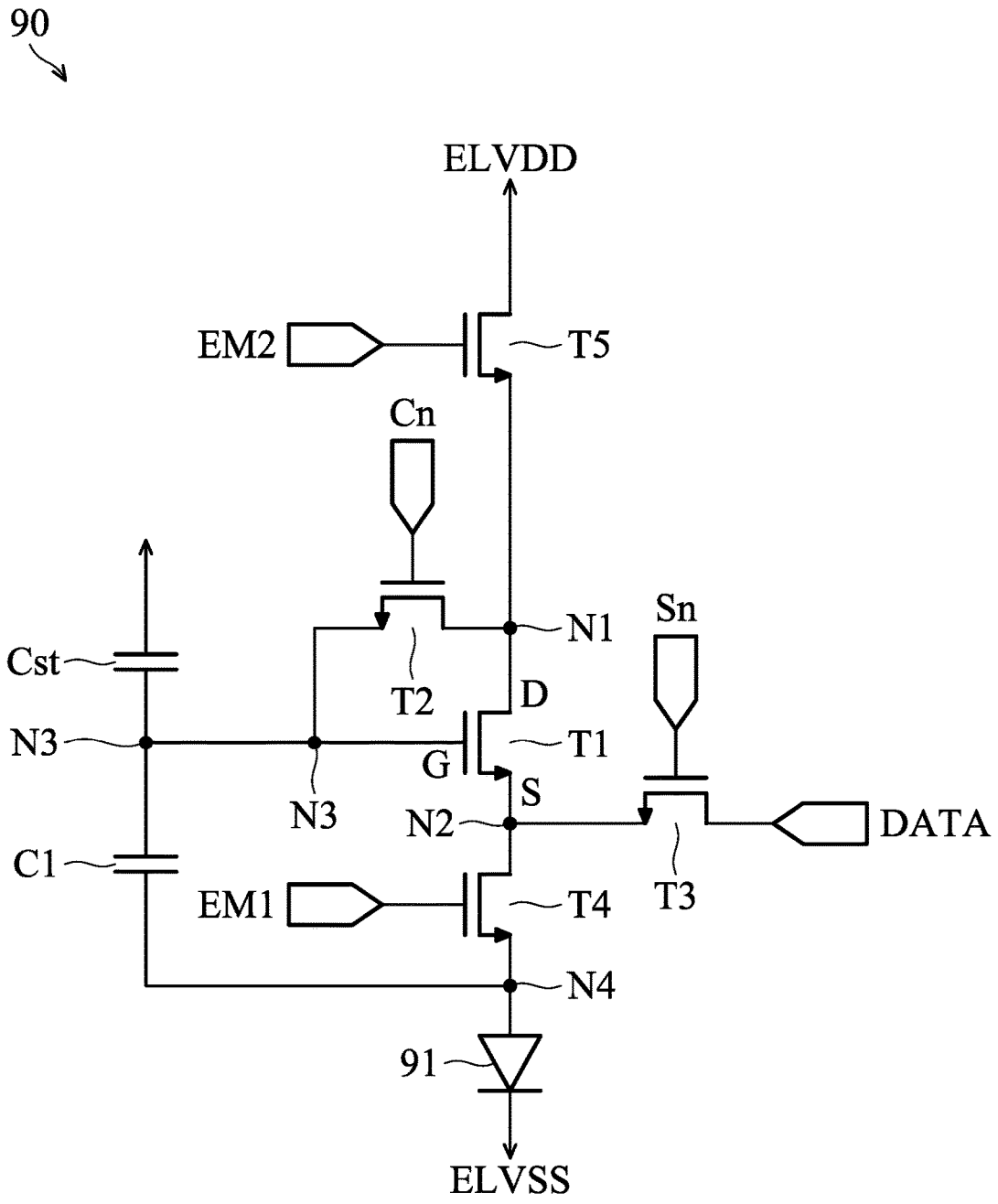
FIG. 9 is a circuit diagram of a driving device according to another embodiment of the disclosure.

FIG. 9 is a circuit diagram of a driving device according to another embodiment of the disclosure. The driving device of FIG. 9 is made up of NMOS transistors to drive a light-emitting element 91. The light-emitting element 91 may be a light-emitting diode (LED), an organic light-emitting diode (OLED) or another light-emitting device. The driving device 90 is made up of five transistors and two capacitors, and the structure can increase the aperture rate of the display devices. The details of the driving device 90 are described in the following paragraph.

The first transistor T1 has a first terminal (labeled as D in FIG. 9) coupled to a first node N1, a second terminal (labeled as S in FIG. 9) coupled to a second node N2, and a gate terminal (labeled as G in FIG. 9) coupled to a third node N3. The second transistor T2 has a first terminal coupled to the first node N1, a second terminal coupled to the third node N3, and a gate terminal to receive a first control signal Cn. The third transistor T3 has a first terminal coupled to the second node N2, a second terminal to receive an image signal for displaying, and a gate terminal to receive a second control signal Sn. The fourth transistor T4 has a first terminal coupled to a fourth node N4, a second terminal coupled to the second node N2, and a gate terminal to receive a fourth control signal EM1. The fifth transistor T5 has a first terminal coupled to a high voltage level ELVDD, a second terminal coupled to the first node N1, and a gate terminal to receive a third control signal EM2. The capacitor Cst has a first terminal coupled to a high voltage level or a DV voltage level, and a second terminal coupled to the third node N3. The second capacitor C1 has a first terminal coupled to the third node N3, and a second terminal coupled to the fourth node N4. The light-emitting element 91 has a first terminal coupled to a voltage level ELVSS and a second terminal coupled to the fourth node N4.

In FIG. 9, the light-emitting element 91 may decay after being turned on for a long time. The capacitor C1 is used to compensate for the light-emitting element 91. In this embodiment, the first transistor T1 is a driving transistor for driving the light-emitting element 91. The second transistor T2 is a compensation transistor to compensate for a threshold voltage (Vt) shift. The third transistor T3 is a data input transistor for receiving an input image signal DATA. In this embodiment, the image signal DATA is in form of current or voltage. The fourth transistor T4 and the fifth transistor T5 are switch transistors to determine whether the light-emitting element 91 is to be enabled.

Figure 10:
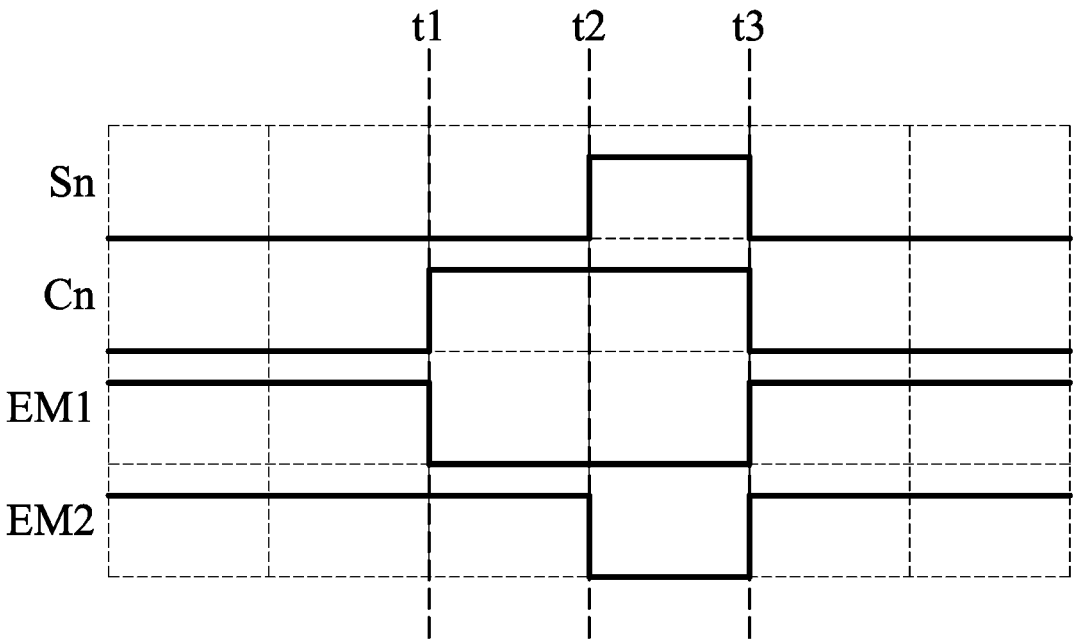
FIG. 10 is a waveform of an embodiment of the operation of the driving device in FIG. 9.

FIG. 10 is a waveform of an embodiment of the operation of the driving device in FIG. 9. Before receiving the image signal DATA, the driving device 90 resets the first transistor T1 by the first control signal Cn and the third control signal EM2. When receiving the image signal DATA, the fourth transistor T4 is not turned on accordingly. The image signal DATA is first compensated for by the second transistor T2, and then the compensated image signal DATA is stored in the capacitor Cst. After the image signal DATA is compensated for, the fourth transistor T4 and the fifth transistor T5 are turned on, and the compensated image signal DATA is transmitted to the light-emitting element 91.

At a first time point t1, the second control signal Sn and the fourth control signal EM1 are at a low voltage logic level to turn off the third transistor T3 and the fourth transistor T4. The first control signal Cn and the third control signal EM2 are at a high voltage logic level to turn on the second transistor T2 and the fifth transistor T5. The voltage level of the third node N3 is pulled up to voltage level ELVDD accordingly, and the first transistor T1 is turned on accordingly.

At a second time point t2, the second control signal Sn is changed to the high voltage logic level to turn on the third transistor T3. The third control signal EM2 is changed to the low voltage logic level to turn off the fifth transistor T5. Due to the image signal DATA, the voltage level of the gate terminal of the first transistor T1 is changed to be ($V_{DATA}$+ $V_{th}$).

At a third time point t3, the first control signal Cn and the second control signal Sn are at the low voltage logic level to turn off the second transistor T2 and the third transistor T3. The third control signal EM2 and the fourth control signal EM1 are changed to the high voltage logic level to turn on the fourth transistor T4 and the fifth transistor T5. The compensated image signal DATA is stored in the capacitor Cst and displayed by the light-emitting element 91.

To clearly illustrate the driving scheme of the embodiment, table VII and table VIII may be referred to.

TABLE VII

| | T1 | T2 | T3 | T4 | T5 |
|---|---|---|---|---|---|
| RESET | ON | ON | OFF | OFF | ON |
| COMPENSATION | ON | ON | ON | OFF | OFF |
| DISPLAY | ON | OFF | OFF | ON | ON |

TABLE VIII

| | G | S | $V_{GS} - \lvert V_{th}\rvert$ |
|---|---|---|---|
| RESET | VDD | floating | X |
| COMPENSATION | $V_{DATA} + V_{th}$ | $V_{DATA}$ | 0 |
| DISPLAY | $V_{DATA} + V_{th}$ | $V_{SS} + V_{oled}$ | $V_{DATA} - (V_{SS} + V_{oled})$ |

TABLE VII shows the status of transistors of the driving device 90 at different time points. TABLE VIII shows the voltage level of the second terminal and the gate terminal of the first transistor T1, and the voltage received by the light-emitting element 91. From TABLE VIII, it is found that the voltage received by the light-emitting element 91 is not affected by the threshold voltage of the first transistor T1 during the display period (after time point t3). In table VIII, the $V_{oled}$ is the threshold voltage of the light-emitting element 91.

Figure 11:
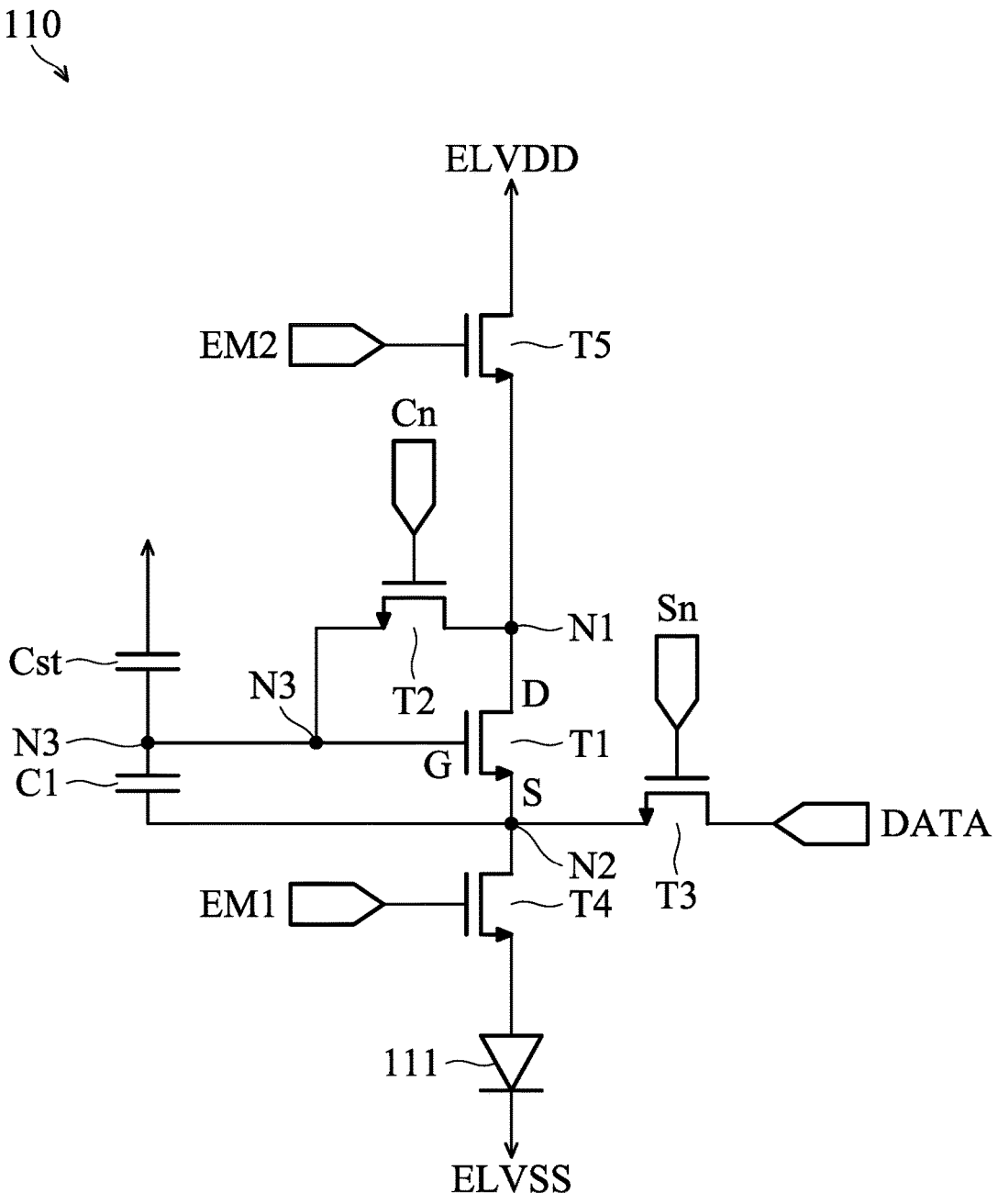
FIG. 11 is a circuit diagram of a driving device according to another embodiment of the disclosure.

FIG. 11 is a circuit diagram of a driving device according to another embodiment of the disclosure. The driving device of FIG. 11 is made up of NMOS transistors to drive a light-emitting element 111. The light-emitting element 111 may be a light-emitting diode (LED), an organic light-emitting diode (OLED) or another light-emitting device. The driving device 110 is made up of five transistors and two capacitors, and the structure can increase the aperture rate of the display devices. The details of the driving device 110 are described in the following paragraph.

The first transistor T1 has a first terminal (labeled as D in FIG. 11) coupled to a first node N1, a second terminal (labeled as S in FIG. 11) coupled to a second node N2, and a gate terminal (labeled as Gin FIG. 11) coupled to a third node N3. The second transistor T2 has a first terminal coupled to the first node N1, a second terminal coupled to the third node N3, and a gate terminal to receive a first control signal Cn. The third transistor T3 has a first terminal coupled to the second node N2, a second terminal to receive an image signal DATA, and a gate terminal to receive a second control signal Sn. The fourth transistor T4 has a first terminal coupled to the light-emitting element 111, a second terminal coupled to the second node N2, and a gate terminal to receive a fourth control signal EM1. The fifth transistor T5 has a first terminal coupled to a high voltage level ELVDD, a second terminal coupled to the first node N1, and a gate terminal to receive a third control signal EM2. The capacitor Cst has a first terminal coupled to a high voltage level ELVDD, and a second terminal coupled to the third node N3. The second capacitor C1 has a first terminal coupled to the third node N3, and a second terminal coupled to the second node N2. The light-emitting element 111 has a first terminal coupled to a voltage level ELVSS and a second terminal coupled to the second node N2.

In FIG. 11, the light-emitting element 111 may decay after being turned on for a long time. The capacitor C1 is used to compensate for the light-emitting element 111. In this embodiment, the first transistor T1 is a driving transistor for driving the light-emitting element 111. The second transistor T2 is a compensation transistor to compensate for a threshold voltage (Vt) shift. The third transistor T3 is a data input transistor for receiving an input image signal DATA. In this embodiment, the image signal DATA is in form of current or voltage. The fourth transistor T4 and the fifth transistor T5 are switch transistors to determine whether the light-emitting element 111 is to be enabled.

Figure 12:
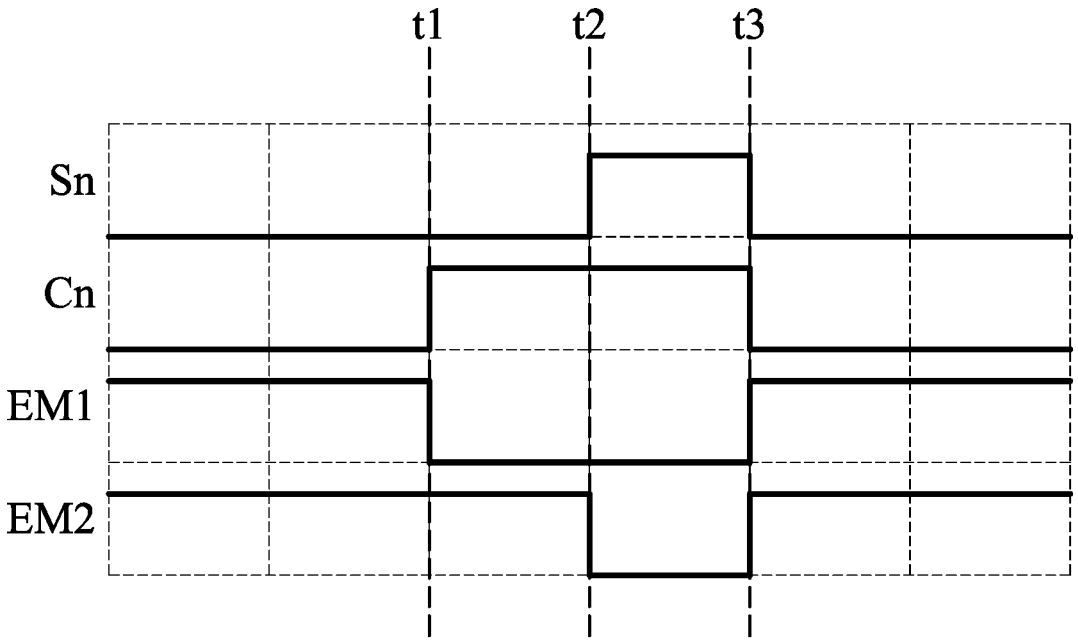
FIG. 12 is a waveform of an embodiment of the operation of the driving device in FIG. 11.

FIG. 12 is a waveform of an embodiment of the operation of the driving device in FIG. 11. Before receiving the image signal DATA, the driving device 110 resets the first transistor T1 by the first control signal Cn and the third control signal EM2. When receiving the image signal DATA, the fourth transistor T4 is not turned accordingly. The image signal DATA is first compensated for by the second transistor T2, and then the compensated image signal DATA is stored in the capacitor Cst. After the image signal DATA is compensated for, the fourth transistor T4 and the fifth transistor T5 are turned on, and the compensated image signal DATA is transmitted to the light-emitting element 111.

At time point t1, the second control signal Sn and the fourth control signal EM1 are at the low voltage logic level to turn off the third transistor T3 and the fourth transistor T4. The first control signal Cn and the third control signal EM2 are at the high voltage logic level to turn on the second transistor T2 and the fifth transistor T5. Since the voltage level of the node N3 is pulled up to voltage level ELVDD, the first transistor T1 is turned on accordingly.

At time point t2, the second control signal Sn is changed to the high voltage logic level, and the third control signal EM2 is changed to the low voltage logic level. The third transistor T3 is turned on and the fifth transistor T5 is turned off. Due to the image signal DATA, the voltage level of the gate terminal of the first transistor T1 is changed to be ($V_{DATA}$+$V_m$).

At time point t3, the first control signal Cn and the second control signal Sn are changed to the low voltage logic level, and the second transistor T2 and the third transistor T3 are turned off accordingly. The third control signal EM2 and the fourth control signal EM1 are changed to the high voltage logic level to turn on the fourth transistor T4 and the fifth transistor T5. The compensated image signal DATA is stored in the capacitor Cst and displayed by the light-emitting element 111.

To clearly illustrate the driving scheme of the embodiment, table IX and table X may be referred to.

TABLE IX

| | T1 | T2 | T3 | T4 | T5 |
|---|---|---|---|---|---|
| RESET | ON | ON | OFF | OFF | ON |
| COMPENSATION | ON | ON | ON | OFF | OFF |
| DISPLAY | ON | OFF | OFF | ON | ON |

TABLE X

| | G | S | $V_{GS}$ − $\|V_m\|$ |
|---|---|---|---|
| RESET | VDD | floating | X |
| COMPENSATION | $V_{DATA}$ + $V_m$ | $V_{DATA}$ | 0 |
| DISPLAY | $V_{DATA}$ + $V_m$ | $V_{SS}$ + $V_{oled}$ | $V_{DATA}$ − ($V_{SS}$ + $V_{oled}$) |

TABLE IX shows the status of transistors of the driving device 110 at different time points. TABLE X shows the voltage levels of the second terminal and the gate terminal of the first transistor T1, and the voltage received by the light-emitting element 111. From TABLE X, it is found that the voltage received by the light-emitting element 111 is not affected by the threshold voltage of the first transistor T1 during the display period (after time point t3). In table VIII, the $V_{oled}$ is the threshold voltage of the light-emitting element 111.

Figure 13:
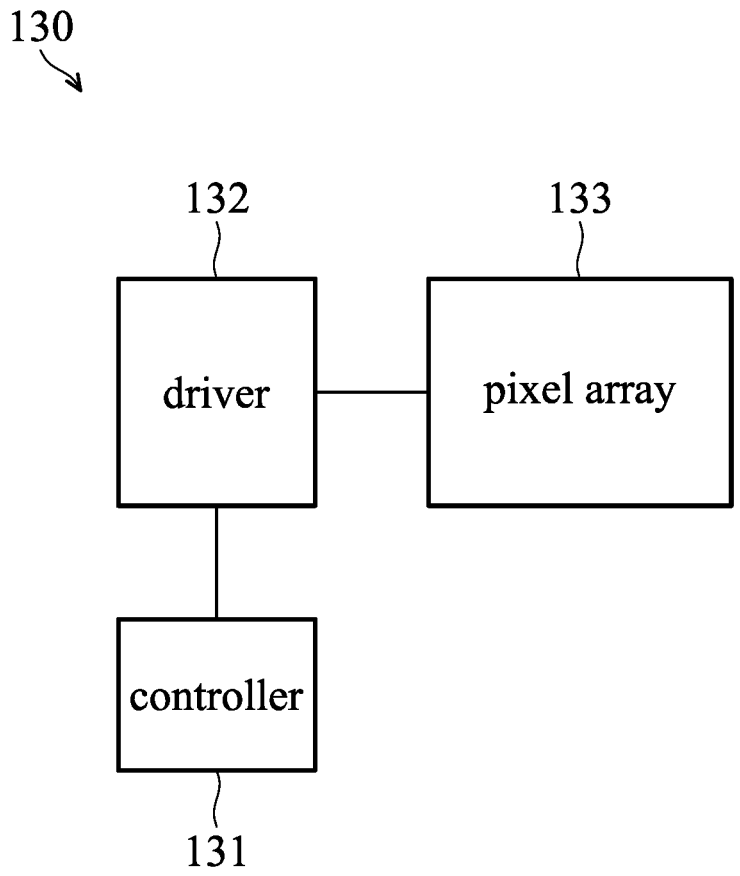
FIG. 13 is a schematic diagram of a display device according to an embodiment of the disclosure.

FIG. 13 is a schematic diagram of a display device according to an embodiment of the disclosure. The display device 130 comprises a controller 131, a driver 132 and a pixel array 133. The controller 131 generates image signals and transmits the image signals to the driver 132 to show the image signals on the pixel array 133. The driver 132 comprises a plurality of driving devices, such the driving devices shown in FIGS. 1, 4, 7, 9 and 11. The pixel array 133 is a matrix array made up of a plurality of light-emitting devices. The light-emitting device may be a light-emitting diode (LED), an organic light-emitting diode (OLED) or another light-emitting device. The operation of driver 132 has been described in paragraphs above.

While the disclosure has been described by way of example and in terms of the embodiments, it is to be understood that the disclosure is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A display device, comprising:

a pixel array;

a driver, having a plurality of driving devices; and a controller, generating image signals and transmitting the image signals to the driver to show the image signals on the pixel array;

each of the driving devices comprising:

a first transistor having a first terminal coupled to a first node, a second terminal coupled to a second node, and a gate terminal coupled to a third node;

a second transistor having a first terminal coupled to the first node, a second terminal coupled to the third node, and a gate terminal to receive a first control signal;

a third transistor having a first terminal coupled to the second node, a second terminal to receive a display signal, and a gate terminal to receive a second control signal;

a fourth transistor having a first terminal coupled to a light-emitting device, a second terminal coupled to the first node, and a gate terminal to receive a third control signal;

a fifth transistor having a first terminal coupled to a high voltage signal, a second terminal coupled to the second node, and a gate terminal to receive a fourth control signal;

a capacitor having a first terminal coupled to the high voltage signal and a second terminal coupled to the third node; and the light-emitting device having a first terminal coupled to a low voltage signal and a second terminal coupled to the first terminal of the fourth transistor, wherein an operation flow of the driving device comprises steps of:

at a first time point, the fourth control signal is at a high voltage logic level to turn off the fifth transistor, and the third control signal is at a low voltage logic level to turn on the fourth transistor;

at a second time point, the third control signal is changed to the high voltage logic level to turn off the fourth transistor; and at a third time point, the third control signal and the fourth control signal are changed to the low voltage logic level to turn on the fourth transistor and the fifth transistor.

2. The display device as claimed in claim 1, wherein an operation flow of the driving device comprises steps of:

at a first time point, the second control signal and the fourth control signal are at a high voltage logic level to turn off the third transistor and the fifth transistor, and the first control signal and the third control signal are at a low voltage logic level to turn on the second transistor and the fourth transistor;

at a second time point, the second control signal is changed to the low voltage logic level to turn on the third transistor, and the third control signal is changed to the high voltage logic level to turn off the fourth transistor; and at a third time point, the first control signal and the second control signal are changed to the high voltage logic level to turn off the second transistor and the third transistor, and the third control signal and the fourth control signal are changed to the low voltage logic level to turn on the fourth transistor and the fifth transistor.

3. The display device as claimed in claim 1, wherein the first control signal is the same as the second control signal, an operation flow of the driving device comprises steps of:

at a first time point, the first control signal, the second control signal, and the third control signal are at a low voltage logic level to turn on the second transistor, the third transistor and the fourth transistor, and the fourth control signal is at a high voltage logic level to turn off the fifth transistor;

at a second time point, the third control signal is changed to the high voltage logic level to turn off the fourth transistor; and at a third time point, the first control signal and the second control signal are changed to the high voltage logic level to turn off the second transistor and the third transistor, and the third control signal and the fourth control signal are changed to the low voltage logic level to turn on the fourth transistor and the fifth transistor.

4. The display device as claimed in claim 1, wherein the third control signal is the same as the fourth control signal, and an operation flow of the driving device comprises steps of:

at a first time point, the second control signal is at a high voltage logic level to turn off the third transistor, and the first control signal, the third control signal and the fourth control signal are at a low voltage logic level to turn on the second transistor, the fourth transistor and the fifth transistor;

at a second time point, the third control signal and the fourth control signal are changed to the high voltage logic level to turn off the fourth transistor and the fifth transistor;

at a third time point, the second control signal is changed to the low voltage logic level to turn on the third transistor; and at a fourth time point, the second control signal is changed to the high voltage logic level to turn off the third transistor, and the third control signal and the fourth control signal are changed to the low voltage logic level to turn on the fourth transistor and the fifth transistor.

5. The display device as claimed in claim 1, wherein the first control signal is the same as the second control signal, the third control signal is the same as the fourth control signal, and an operation flow of the driving device comprises steps of:

at a first time point, the first control signal, the second control signal, the third control signal and the fourth control signal are at a low voltage logic level to turn on all transistors of the driving device;

at a second time point, the third control signal and the fourth control signal are changed to a high voltage logic level to turn off the fourth transistor and the fifth transistor;

at a third time point, the first control signal and the second control signal are changed to the high voltage logic level to turn off the second transistor and the third transistor;

at a fourth time point, the first control signal and the second control signal are changed to the low voltage logic level to turn on the second transistor and the third transistor;

at a fifth time point, the first control signal and the second control signal are changed to the high voltage logic level to turn off the second transistor and the third transistor, and the third control signal and the fourth control signal are changed to the low voltage logic level to turn on the fourth transistor and the fifth transistor.

6. A display device, comprising:

a pixel array;

a driver, having a plurality of driving devices; and a controller, generating image signals and transmitting the image signals to the driver to show the image signals on the pixel array;

each of the driving devices comprising:

a first transistor having a first terminal coupled to a first node, a second terminal coupled to a second node, and a gate terminal coupled to a third node;

a second transistor having a first terminal coupled to the first node, a second terminal coupled to the third node and a gate terminal to receive a first control signal;

a third transistor having a first terminal coupled to the second node, a second terminal to receive a display signal, and a gate terminal to receive a second control signal;

a fourth transistor having a first terminal coupled to a fourth node, a second terminal coupled to the first node, and a gate terminal to receive a third control signal;

a fifth transistor having a first terminal coupled to a high voltage signal, a second terminal couple to the second node, and a gate terminal to receive a fourth control signal;

a sixth transistor having a first terminal coupled to a reference voltage signal, a second terminal coupled to the fourth node, and a gate terminal to receive a reset signal;

a capacitor having a first terminal coupled to the high voltage signal, and a second terminal coupled to the third node, and a light-emitting device having a first terminal coupled to a low voltage signal and a second terminal coupled to the fourth node, wherein an operation flow of the driving device comprises steps of:

at a first time point, the fourth control signal is at a high voltage logic level to turn off the fifth transistor, and the third control signal is at a low voltage logic level to turn on the fourth transistor;

at a second time point, the third control signal is changed to the high voltage logic level to turn off the fourth transistor; and at a third time point, the third control signal and the fourth control signal are changed to the low voltage logic level to turn on the fourth transistor and the fifth transistor.

7. The display device as claimed in claim 6, wherein an operation flow of the driving device comprises steps of:

at a first time point, the second control signal is at a high voltage logic level to turn off the third transistor, and the reset signal and the first control signal are at a low voltage logic level to turn on the sixth transistor and the second transistor;

at a second time point, the second control signal is changed to the low voltage logic level to turn on the third transistor, and the reset signal is changed to the high voltage logic level to turn off the sixth transistor; and at a third time point, the first control signal and the second control signal are changed to the high voltage logic level to turn off the second transistor and the third transistor.

8. The display device as claimed in claim 6, wherein the first control signal is the same as the second control signal, an operation flow of the driving device comprises steps of:

at a first time point, the fourth control signal is at a high voltage logic level to turn off the fifth transistor, the reset signal, the first control signal, the second control signal, and the third control signal are at a low voltage logic level to turn on the sixth transistor, the second transistor, the third transistor and the fourth transistor;

at a second time point, the third control signal is changed to the high voltage logic level to turn off the fourth transistor; and at a third time point, the reset signal, the first control signal and the second control signal are changed to the high voltage logic level to turn off the sixth transistor, the second transistor and the third transistor, and the third control signal and the fourth control signal are changed to the low voltage logic level to turn on the fourth transistor and the fifth transistor.

9. The display device as claimed in claim 6, wherein the third control signal is the same as the fourth control signal, and an operation flow of the driving device comprises steps of:

at a first time point, the second control signal is at a high voltage logic level to turn off the third transistor, and the reset signal, the first control signal, the third control signal and the fourth control signal are at a low voltage logic level to turn on the sixth transistor, the second transistor, the fourth transistor and the fifth transistor;

at a second time point, the third control signal and the fourth control signal are changed to the high voltage logic level to turn off the fourth transistor and the fifth transistor;

at a third time point, the second control signal is changed to the low voltage logic level to turn on the third transistor;

at a fourth time point, the reset signal is changed to the high voltage logic level to turn off the sixth transistor; and at a fifth time point, the first control signal and the second control signal are changed to the high voltage logic level to turn off the second transistor and the third transistor, and the third control signal and the fourth control signal are changed to the low voltage logic level to turn on the second transistor, the fourth transistor and the fifth transistor.

10. The display device as claimed in claim 6, wherein the reset signal, the first control signal and the second control signal are the same, the third control signal is the same as the fourth control signal, and an operation flow of the driving device comprises steps of:

at a first time point, the reset signal, the first control signal, the second control signal, the third control signal and the fourth control signal are at a low voltage logic level to turn on all transistors of the driving device;

at a second time point, the third control signal and the fourth control signal are changed to a high voltage logic level to turn off the fourth transistor and the fifth transistor;

at a third time point, the first control signal and the second control signal are changed to the high voltage logic level to turn off the second transistor and the third transistor;

at a fourth time point, the first control signal and the second control signal are changed to the low voltage logic level to turn on the second transistor and the third transistor;

at a fifth time point, the first control signal and the second control signal are changed to the high voltage logic level to turn off the second transistor and the third transistor, and the third control signal and the fourth control signal are changed to the low voltage logic level to turn on the fourth transistor and the fifth transistor.

* * * * *